US011495868B2

(12) United States Patent
Ahadi et al.

(10) Patent No.: US 11,495,868 B2
(45) Date of Patent: Nov. 8, 2022

(54) EMNZ METAMATERIAL CONFIGURED TO FORM A SWITCH, A MULTIPLEXER, AND A PHASE SHIFTER

(71) Applicants: Mehran Ahadi, Tehran (IR); Amir Jafargholi, Tehran (IR); Parviz Parvin, Tehran (IR)

(72) Inventors: Mehran Ahadi, Tehran (IR); Amir Jafargholi, Tehran (IR); Parviz Parvin, Tehran (IR)

(73) Assignee: AMIRKABIR UNIVERSITY OF TEHRAN, Tehran (IR)

( * ) Notice: Subject to any disclaimer, the term of this patent is extended or adjusted under 35 U.S.C. 154(b) by 0 days.

(21) Appl. No.: 17/166,037

(22) Filed: Feb. 3, 2021

(65) Prior Publication Data

US 2021/0184323 A1 Jun. 17, 2021

Related U.S. Application Data

(63) Continuation-in-part of application No. 17/096,482, filed on Nov. 12, 2020.

(60) Provisional application No. 62/970,191, filed on Feb. 5, 2020, provisional application No. 62/934,012, filed on Nov. 12, 2019.

(51) Int. Cl.

| | |
|---|---|
| ***H01P 1/10*** | (2006.01) |
| ***H01P 1/18*** | (2006.01) |
| ***H01P 1/213*** | (2006.01) |

(52) U.S. Cl.

CPC ..... *H01P 1/10* (2013.01); *H01P 1/18* (2013.01); *H01P 1/184* (2013.01); *H01P 1/213* (2013.01)

(58) Field of Classification Search

CPC .... H01P 1/10; H01P 1/18; H01P 1/184; H01P 1/213

USPC ..... 333/101, 156, 126

See application file for complete search history.

(56) References Cited

U.S. PATENT DOCUMENTS

| | | | | |
|---|---|---|---|---|
| 7,355,492 | B2 * | 4/2008 | Hyman et al. | H01P 1/18 333/164 |
| 10,833,381 | B2 * | 11/2020 | Urzhumov et al. | H01Q 3/40 |
| 2009/0174499 | A1 * | 7/2009 | Hiramatsu et al. | H01P 1/18 333/139 |

(Continued)

OTHER PUBLICATIONS

"Parametric study on the use of magneto-dielectric materials for antenna miniaturization" by A. Louzir et al., published in 2010 IEEE Antennas and Propagation Society International Symposium, pp. 1-4. IEEE, 2010.

(Continued)

*Primary Examiner* — Benny T Lee

(74) *Attorney, Agent, or Firm* — Bajwa IP Law Firm; Haris Zaheer Bajwa

(57) ABSTRACT

A metamaterial switch. The metamaterial switch includes a first conductive plate, a first loaded conductive plate, and a magneto-dielectric material. The first loaded conductive plate includes a second conductive plate and a first tunable impedance surface set. Each tunable impedance surface in the first tunable impedance surface set includes a respective tunable conductivity. An effective permittivity of the metamaterial switch is configured to be adjusted to a first predetermined value. The effective permittivity of the metamaterial switch is adjusted responsive to tuning a respective tunable conductivity of each respective tunable impedance surface in the first tunable impedance surface set.

19 Claims, 40 Drawing Sheets

(56) References Cited

U.S. PATENT DOCUMENTS

2019/0074566 A1* 3/2019 Jeon et al. ..... H01P 1/10

OTHER PUBLICATIONS

"Frequently-Used Properties of the Floor Function", by Xingbo Wang, International Journal of Applied Physics and Mathematics, Oct. 2020.

* cited by examiner

100

202B

202C

202D

202E

202F

400A

400A

600

742

EMNZ METAMATERIAL CONFIGURED TO FORM A SWITCH, A MULTIPLEXER, AND A PHASE SHIFTER

CROSS-REFERENCE TO RELATED APPLICATION

This application is a continuation-in-part of U.S. patent application Ser. No. 17/096,482, filed on Nov. 12, 2020, and entitled "ADJUSTING A CUTOFF FREQUENCY OF AN EMNZ METAMATERIAL", which took priority from U.S. Provisional Patent Application Ser. No. 62/934,012 filed on Nov. 12, 2019, and entitled "BROADBAND GUIDED STRUCTURE WITH NEAR-ZERO PERMITTIVITY, PERMEABILITY, AND REFRACTIVE INDEX," and also claims the benefit of priority from U.S. Provisional Patent Application Ser. No. 62/970,191, filed on Feb. 5, 2020, and entitled "RECONFIGURABLE DEVICES USING EMNZ METAMATERIALS" which are all incorporated herein by reference in their entirety.

TECHNICAL FIELD

The present disclosure generally relates to metamaterials, and particularly, to microwave devices based on epsilon-and-mu-near-zero (EMNZ) metamaterials.

BACKGROUND

Metamaterials are artificial composites with physical characteristics that are not naturally available. Among physical characteristics, refractive index near-zero (INZ) characteristic is attractive to researchers and engineers because INZ metamaterials may transmit waves without altering phase of waves. As a result, a transient wave phase may remain constant when the transient wave travels in an INZ metamaterial. In other words, wavelengths of propagating waves in INZ metamaterials may tend to be infinite, making wave phase independent of waveguide dimensions and shape.

INZ metamaterials are divided into three categories: epsilon-near-zero (ENZ) metamaterials with near-zero permittivity coefficient, mu-near-zero (MNZ) metamaterials with near-zero permeability coefficient, and epsilon-and-mu-near-zero (EMNZ) metamaterials with near-zero permittivity and permeability coefficients. An application of ENZ or EMNZ metamaterials may include antenna design, where ENZ or EMNZ metamaterials are utilized for tailoring antenna radiation patterns, that is, to attain highly directive radiation patterns or enhancing a radiation efficiency. Metamaterials with near-zero parameters are also utilized for tunneling of electromagnetic energy within ultra-thin sub-wavelength ENZ channels or bends (a phenomenon referred to as super-coupling), tunneling through large volumes using MNZ structures, and to overcome weak coupling between different electromagnetic components that are conventionally not well matched, for example, for transition from a coaxial cable to a waveguide.

A permittivity and a permeability of a material may vary in different frequencies. As a result, an EMNZ metamaterial may exhibit near-zero characteristics, that is, near-zero permittivity and near-zero permeability, only in a specific frequency range. In contrast to appealing characteristics for use in microwave and antenna engineering, EMNZ metamaterials may suffer from very limited bandwidth, that is, near-zero characteristics may be attainable only in a limited frequency range, which may limit applications of EMNZ metamaterials with regards to microwave and antenna engineering. Moreover, for an EMNZ metamaterial, a frequency range with near-zero characteristics may not be adjustable, that is, a cutoff frequency of the EMNZ metamaterial may be constant. As a result, applications of the EMNZ metamaterial may be confined to a specific frequency range.

There is, therefore, a need for an EMNZ metamaterial exhibiting near-zero characteristics in a wide frequency range. There is also a need for an EMNZ metamaterial with an adjustable cutoff frequency. There is further a need for reconfigurable microwave devices such as switches, multiplexers, and phase shifters in a compact size and operating in a wide frequency range.

SUMMARY OF THE INVENTION

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure describes an exemplary metamaterial switch. An exemplary metamaterial switch may include a first conductive plate, a first loaded conductive plate, and a magneto-dielectric material. In an exemplary embodiment, the first loaded conductive plate may include a second conductive plate and a first tunable impedance surface set. An exemplary second conductive plate may be parallel with the first conductive plate. In an exemplary embodiment, each tunable impedance surface in the first tunable impedance surface set may include a respective tunable conductivity. In an exemplary embodiment, the first tunable impedance surface set may be positioned between the first conductive plate and the second conductive plate. An exemplary magneto-dielectric material may be deposited on the first loaded conductive plate. In an exemplary embodiment, an effective permittivity of the metamaterial switch may be configured to be adjusted to a first predetermined value. In an exemplary embodiment, the effective permittivity of the metamaterial switch may be adjusted responsive to tuning a respective tunable conductivity of each respective tunable impedance surface in the first tunable impedance surface set.

An exemplary metamaterial switch may be configured to be closed by setting a respective tunable conductivity of each tunable impedance surface in the first tunable impedance surface set larger than a conductivity threshold. An exemplary metamaterial switch may be further configured to be opened by setting a respective tunable conductivity of each tunable impedance surface in the first tunable impedance surface set smaller than the conductivity threshold.

An exemplary metamaterial switch may further include a second loaded conductive plate. An exemplary second loaded conductive plate may include a third conductive plate and a second tunable impedance surface set. In an exemplary embodiment, the third conductive plate may be parallel with the second conductive plate. In an exemplary embodiment, each tunable impedance surface in the second tunable impedance surface set may include a respective tunable conductivity. In an exemplary embodiment, the second tunable impedance surface set may be positioned between the first conductive plate and the third conductive plate. An exemplary first conductive plate may be positioned between the first loaded conductive plate and the second loaded conductive plate. In an exemplary embodiment, the effective permittivity of the metamaterial switch is configured to be adjusted to a second predetermined value. In an exemplary embodiment, the effective permittivity of the metamaterial switch may be adjusted responsive to tuning a respective tunable conductivity of each respective tunable impedance surface in the second tunable impedance surface set.

In an exemplary embodiment, a respective tunable conductivity of each tunable impedance surface in the second tunable impedance surface set may be equal to a respective tunable conductivity of each respective tunable impedance surface in the first tunable impedance surface set.

In an exemplary embodiment, each tunable impedance surface in the first tunable impedance surface set may include a respective graphene monolayer of a graphene monolayer set. In an exemplary embodiment, each tunable impedance surface in the second tunable impedance surface set may include a respective graphene monolayer of the graphene monolayer set.

In an exemplary embodiment, a respective tunable conductivity of each tunable impedance surface in each of the first tunable impedance surface set and the second tunable impedance surface set may be configured to be set larger than the conductivity threshold by applying a first electric potential to each respective graphene monolayer in the graphene monolayer set. In an exemplary embodiment, a respective tunable conductivity of each tunable impedance surface in each of the first tunable impedance surface set and the second tunable impedance surface set may be configured to be set smaller than the conductivity threshold by applying a second electric potential to each respective graphene monolayer in the graphene monolayer set.

An exemplary metamaterial switch may further include a first dielectric spacer set and a second dielectric spacer set. In an exemplary embodiment, each dielectric spacer in the first dielectric spacer set may be coated on a respective graphene monolayer in the graphene monolayer set. In an exemplary embodiment, each dielectric spacer in the first dielectric spacer set may be attached to the second conductive plate. In an exemplary embodiment, a thickness of each dielectric spacer in the first dielectric spacer set may be equal to or smaller than a quarter of an operating wavelength of the metamaterial switch. In an exemplary embodiment, a permittivity of each dielectric spacer in the first dielectric spacer set may be equal to a permittivity of the magneto-dielectric material. In an exemplary embodiment, a permeability of each dielectric spacer in the first dielectric spacer set may be equal to a permeability of the magneto-dielectric material.

In an exemplary embodiment, each dielectric spacer in the second dielectric spacer set may be coated on a respective graphene monolayer in the graphene monolayer set. In an exemplary embodiment, each dielectric spacer in the second dielectric spacer set may be attached to the third conductive plate. In an exemplary embodiment, a thickness of each dielectric spacer in the second dielectric spacer set may be equal to or smaller than a quarter of the operating wavelength. In an exemplary embodiment, a permittivity of each dielectric spacer in the second dielectric spacer set may be equal to the permittivity of the magneto-dielectric material. In an exemplary embodiment, a permeability of each dielectric spacer in the second dielectric spacer set may be equal to a permeability of the magneto-dielectric material.

In an exemplary embodiment, a length of each impedance surface in each of the first tunable impedance surface set and the second tunable impedance surface set may satisfy one of a first length condition, a second length condition, a third length condition, and a fourth length condition. An exemplary first length condition may include $l_i<l_{i+1}$, where $l_{ti}$ is a length of an $i^{th}$ tunable impedance surface in each of the first tunable impedance surface set and the second tunable impedance surface set, $1\leq i\leq N-1$, and N is a size of each of the first tunable impedance surface set and the second tunable impedance surface set. An exemplary second length condition may include $l_i>l_{i+1}$. An exemplary third length condition may include $l_j<l_{j+1}$ and $$l_{\left\lfloor \frac{N+1}{2}+k \right\rfloor} = l_{\left\lfloor \frac{N+1}{2}-k \right\rfloor}, \text{ where } 1 \leq j \leq \left\lceil \frac{N}{2} \right\rceil, 1 \leq k \leq \left\lfloor \frac{N}{2} \right\rfloor, \lfloor . \rfloor$$

is a floor operator, and $\lceil \cdot \rceil$ is a ceiling operator. An exemplary fourth length condition may include $l_j>l_{j+1}$ and $$l_{\left\lfloor \frac{N+1}{2}+k \right\rfloor} = l_{\left\lfloor \frac{N+1}{2}-k \right\rfloor}.$$

An exemplary first conductive plate is positioned between a respective proximal end and a respective distal end of each respective tunable impedance surface in each of the first tunable impedance surface set and the second tunable impedance surface set.

Other exemplary systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the claims herein.

BRIEF DESCRIPTION OF THE DRAWINGS

The drawing figures depict one or more implementations in accord with the present teachings, by way of example only, not by way of limitation. In the figures and in the detail description, like reference numerals refer to the same or similar elements.

DETAILED DESCRIPTION OF THE INVENTION

Figure 1A:
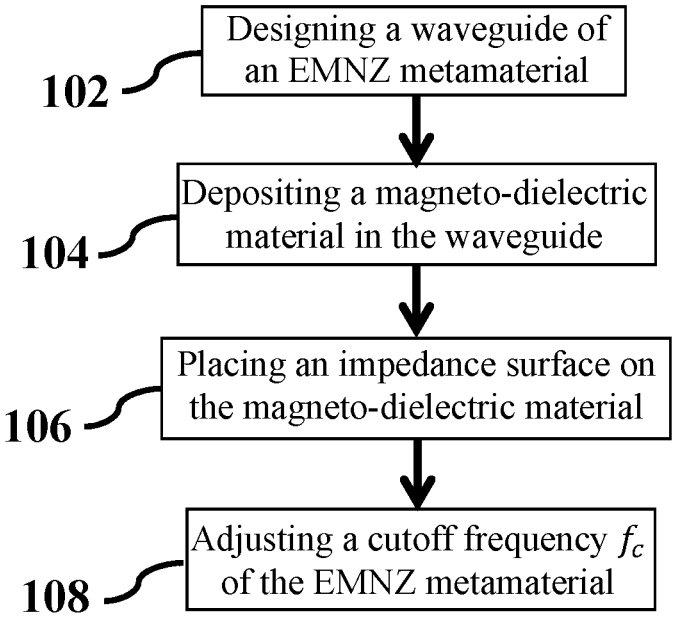
FIG. 1A shows a flowchart of a method for adjusting a cutoff frequency $f_c$ of an epsilon-and-mu-near-zero (EMNZ) metamaterial, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed an exemplary epsilon-and-mu-near-zero (EMNZ) metamaterial. Herein is also disclosed an exemplary method for adjusting a cutoff frequency of an exemplary EMNZ metamaterial. An exemplary EMNZ metamaterial may include a waveguide with a small length compared with an operating wavelength. At frequencies smaller than an exemplary cutoff frequency of the waveguide, an insertion loss of the waveguide may be negligible while the waveguide may exhibit near-zero characteristics. Some waveguide structures such as parallel-plate waveguides may not include a cutoff frequency, that is, a minimum frequency of an exemplary electromagnetic wave that may pass through a waveguide. As a result, parallel plate waveguides may not exhibit near-zero characteristics. In an exemplary embodiment, "near-zero characteristics" may refer to near-zero permittivity and near-zero permeability. Utilizing an impedance surface in a waveguide may change a propagation mode to a transverse magnetic (TM) propagation mode. As a result, a waveguide with an impedance surface may introduce a cutoff frequency. Therefore, utilizing an impedance surface, near-zero characteristics may be obtained in various waveguide structures.

A cutoff frequency may depend on geometric properties of a waveguide. As a result, a cutoff frequency of an exemplary EMNZ metamaterial constructed by a waveguide may be constant. To make the cutoff frequency adjustable, a tunable impedance surface may be utilized instead of a simple impedance surface. An exemplary tunable impedance surface may include an adjustable conductivity. Therefore, a cutoff frequency of the EMNZ metamaterial may be adjusted by adjusting a conductivity of a tunable impedance surface. An exemplary graphene monolayer may exhibit an appreciable impedance at Terahertz, visible light, and GHz frequency ranges. As a result, an exemplary graphene monolayer may be utilized as a tunable impedance surface. However, to benefit from using a graphene monolayer, the graphene monolayer may be separated from an upper wall of the waveguide by a dielectric spacer to avoid a short circuit.

A number of microwave devices such as switches, multiplexers, and phase shifters may be implemented utilizing adjustability of an exemplary EMNZ metamaterial. An insertion loss of an EMNZ metamaterial in frequencies larger than a cutoff frequency of the EMNZ metamaterial may be negligible. An exemplary cutoff frequency of the EMNZ metamaterial may be increased utilizing adjustability of an EMNZ metamaterial. As a result, an insertion loss of the EMNZ metamaterial may be very high in frequencies smaller than an increased cutoff frequency of the EMNZ metamaterial. Therefore, an insertion loss of an EMNZ metamaterial may be adjusted by adjusting a cutoff frequency of the EMNZ metamaterial.

Adjustability of an insertion loss of an EMNZ metamaterial may pave a way for implementation of a microwave switch. An EMNZ metamaterial may be regarded as a metamaterial switch and may be configured to be opened and closed by adjusting a cutoff frequency of the EMNZ metamaterial. Moreover, a multiplexer may be implemented utilizing a number of transmission lines, such as microstrips and striplines, that are controllable by a number of switches. Therefore, metamaterial switches may be implemented utilizing metamaterial switches. Moreover, a phase shifter may be implemented utilizing a number of transmission lines with various delay lines and controlling an output of each transmission line by a switch. As a result, a phase shifter may also be implemented by a metamaterial switch.

FIG. 1A shows a flowchart of a method for adjusting a cutoff frequency $f_c$ of an EMNZ metamaterial, consistent with one or more exemplary embodiments of the present disclosure. In an exemplary embodiment, a method 100 may include designing a waveguide of an EMNZ metamaterial (step 102), depositing a magneto-dielectric material (step 104), placing an impedance surface on the magneto-dielectric material (step 106), and adjusting a cutoff frequency $f_c$ of the EMNZ metamaterial (step 108). In an exemplary embodiment, method 100 may be utilized to design an EMNZ metamaterial based on a waveguide. In an exemplary embodiment, method 100 may be further utilized for adjusting a cutoff frequency of the EMNZ metamaterial.

Figure 2A:
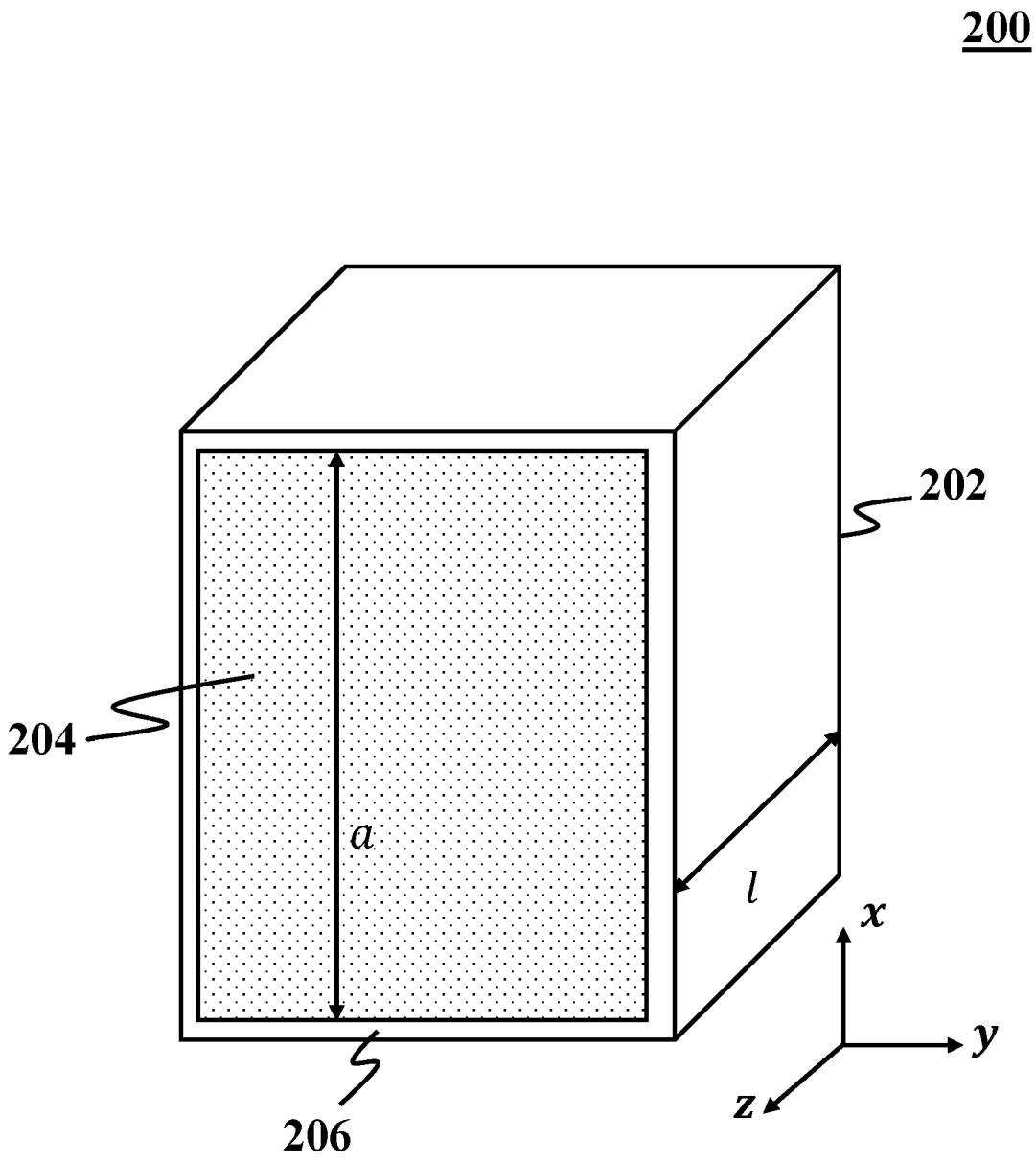
FIG. 2A shows a schematic of an EMNZ metamaterial, consistent with one or more exemplary embodiments of the present disclosure.

FIG. 2A shows a schematic of an EMNZ metamaterial, consistent with one or more exemplary embodiments of the present disclosure. In an exemplary embodiment, different steps of method 100 in FIG. 1A may be implemented utilizing an EMNZ metamaterial 200. In an exemplary embodiment, EMNZ metamaterial 200 may include a waveguide 202 and a magneto-dielectric material 204. An exemplary orientation of EMNZ metamaterial 200 is shown in FIG. 2A with respect to horizontal (x), vertical (y), and out of plane (z) directions.

In an exemplary embodiment, step 102 in FIG. 1A may include designing waveguide 202 by determining a length l of waveguide 202. In an exemplary embodiment, length l may be determined based on a length condition defined by $l \leq 0.1\lambda$, where $\lambda$ is an operating wavelength of EMNZ metamaterial 200. In an exemplary embodiment, length l may refer to a length of a path that a wave may travel in waveguide 202, that is, a length of waveguide 202 along the z direction. In an exemplary embodiment, an ability of waveguide 202 for passing a wave may depend on a size of a cross-section of waveguide 202 and a wavelength of the wave. In an exemplary embodiment, when a wavelength of a wave is larger than a threshold, an insertion loss of waveguide 202 may be very large, that is, the wave may not pass through waveguide 202. An exemplary threshold may refer to a "cutoff wavelength" (or consistently, a "cutoff frequency") of waveguide 202. On the other hand, in an exemplary embodiment, an effective permittivity and an effective permeability of waveguide 202 may be near-zero in frequencies smaller than the cutoff frequency. As a result, waveguide 202 may act as an EMNZ metamaterial in frequencies smaller than the cutoff frequency. However, an energy of an exemplary wave with a frequency smaller than the cutoff frequency may be significantly decreased due to high insertion loss. An exemplary insertion loss of waveguide 202 for frequencies smaller than the cutoff frequency may depend on length l, that is, the insertion loss may be larger for larger values of length l. As a result, in an exemplary embodiment, when length l is very small compared with a wavelength of a passing wave, the insertion loss may become small and the passing wave may pass through waveguide 202 without a significant energy dissipation. As a result, in an exemplary embodiment, waveguide 202 with a small length, that is $l \leq 0.1\lambda$, may act as an EMNZ metamaterial at frequencies smaller than the cutoff frequency.

Figure 2B:
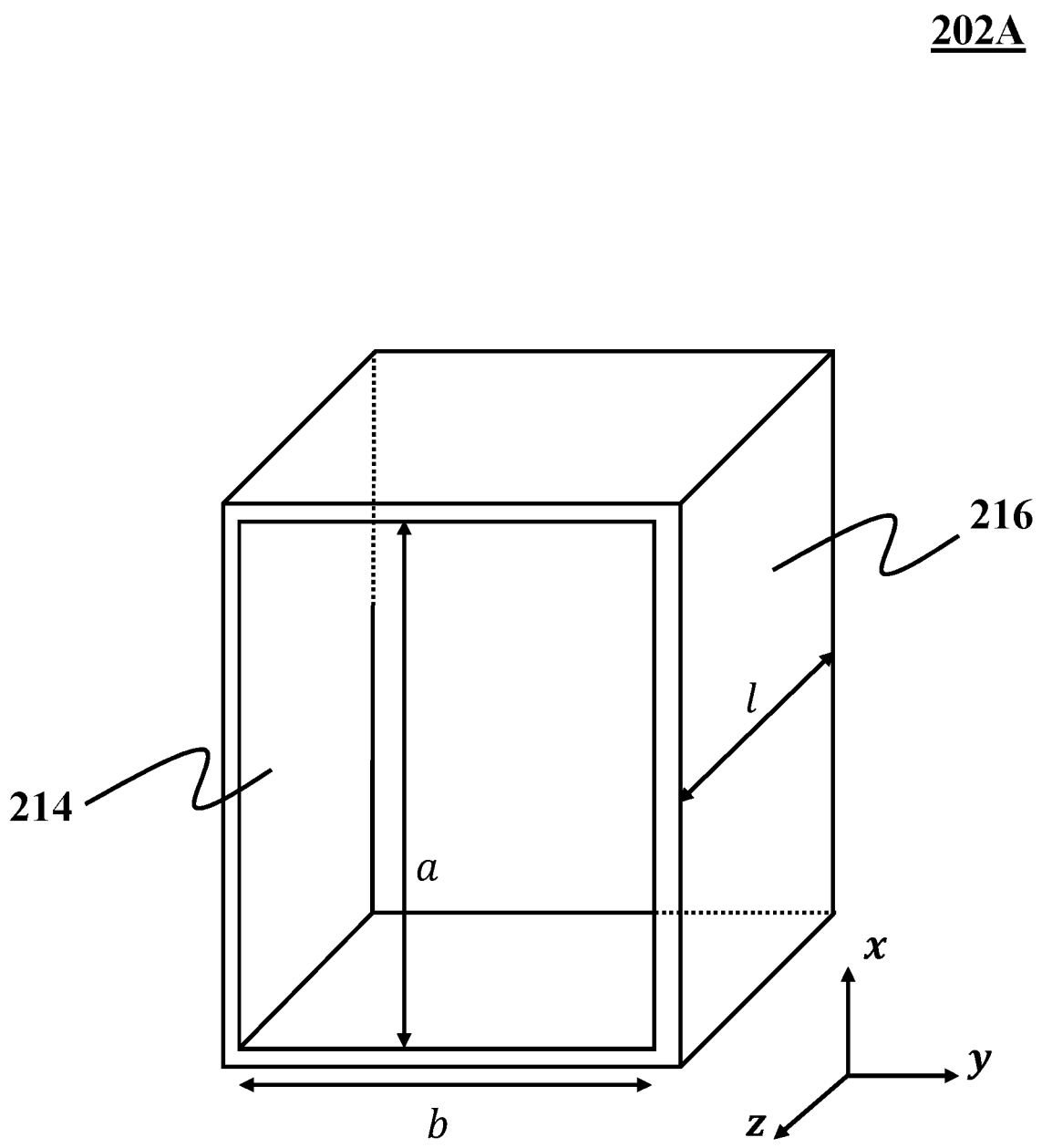
FIG. 2B shows a schematic of a rectangular waveguide, consistent with one or more exemplary embodiments of the present disclosure.
Figure 2C:
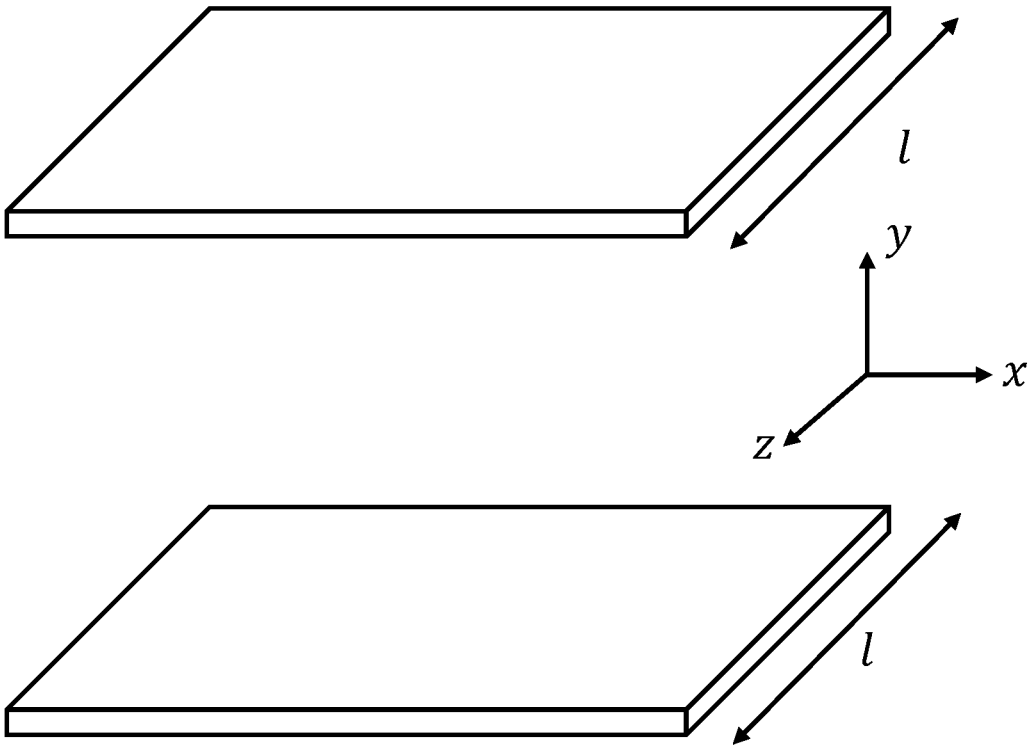
FIG. 2C shows a schematic of a parallel-plate waveguide, consistent with one or more exemplary embodiments of the present disclosure.

FIG. 2B shows a schematic of a rectangular waveguide, consistent with one or more exemplary embodiments of the present disclosure. FIG. 2C shows a schematic of a parallel-plate waveguide, consistent with one or more exemplary embodiments of the present disclosure. Referring to FIGS. 2A-2C, in an exemplary embodiment, designing waveguide 202 in step 102 in FIG. 1A may include designing one of a rectangular waveguide 202A and a parallel-plate waveguide 202B. In an exemplary embodiment, rectangular waveguide 202A in FIG. 2B may include a first implementation of waveguide 202. In an exemplary embodiment, parallel-plate waveguide 202B in FIG. 2C may include a second implementation of waveguide 202. In an exemplary embodiment, parallel-plate waveguide 202B may be infinitely extended in the x direction.

In an exemplary embodiment, as shown in FIG. 2A, step 104 in FIG. 1A may include depositing magneto-dielectric material 204. In an exemplary embodiment, magneto-dielectric material 204 may be deposited on a lower wall 206 of waveguide 202 by deposition techniques such as chemical deposition and physical deposition. In an exemplary embodiment, chemical deposition may cause a chemical change in a fluid on a solid surface, resulting in a solid layer. In an exemplary embodiment, physical deposition may utilize mechanical, electromechanical or thermodynamic means to produce a solid layer. In an exemplary embodiment, waveguide 202 may be filled by depositing magneto-dielectric material 204. In an exemplary embodiment, a cutoff frequency of waveguide 202 may depend on a permittivity and a permeability of magneto-dielectric material 204. In an exemplary embodiment, as shown in FIG. 2B, a cutoff frequency of rectangular waveguide 202A may be given according to an operation defined by:

$$f_c = \frac{1}{2d\sqrt{\mu_0 \epsilon}} \qquad \text{Equation (1)}$$

where d=max {a, b}, a is a height of rectangular waveguide 202A, b is a width of rectangular waveguide 202A, $\mu_0$ is a permeability of free space, and $\epsilon$ is a permittivity of magneto-dielectric material 204.

Figure 2D:
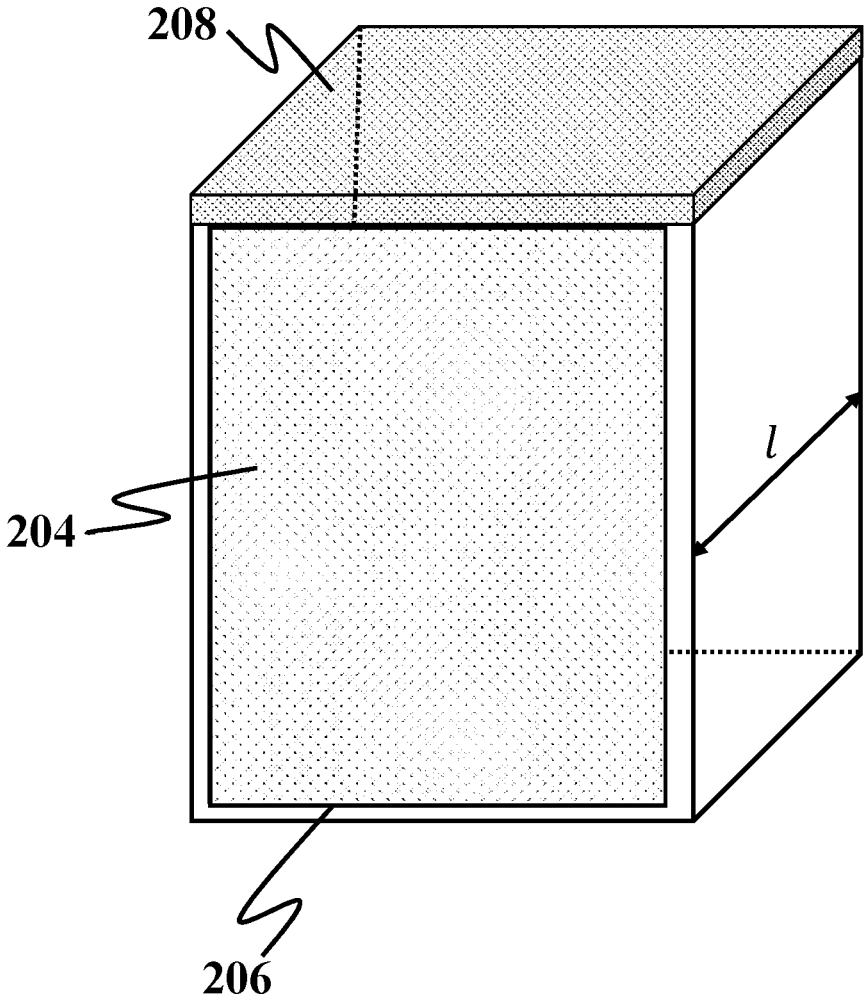
FIG. 2D shows a schematic of an impedance surface waveguide, consistent with one or more exemplary embodiments of the present disclosure.

FIG. 2D shows a schematic of an impedance surface waveguide, consistent with one or more exemplary embodiments of the present disclosure. In an exemplary embodiment, an impedance surface waveguide 202C may include a third implementation of waveguide 202. In an exemplary embodiment, impedance surface waveguide 202C may include an impedance surface 208.

In an exemplary embodiment, as shown in FIG. 2D, step 106 in FIG. 1A may include placing impedance surface 208 on magneto-dielectric material 204. In an exemplary embodiment, impedance surface 208 may operate as an upper wall of impedance surface waveguide 202C. In an exemplary embodiment, placing impedance surface 208 may change a transverse electric (TE) propagation mode in waveguide 202 in FIG. 2A to a TM propagation mode in impedance surface waveguide 202C in FIG. 2D.

Figure 2E:
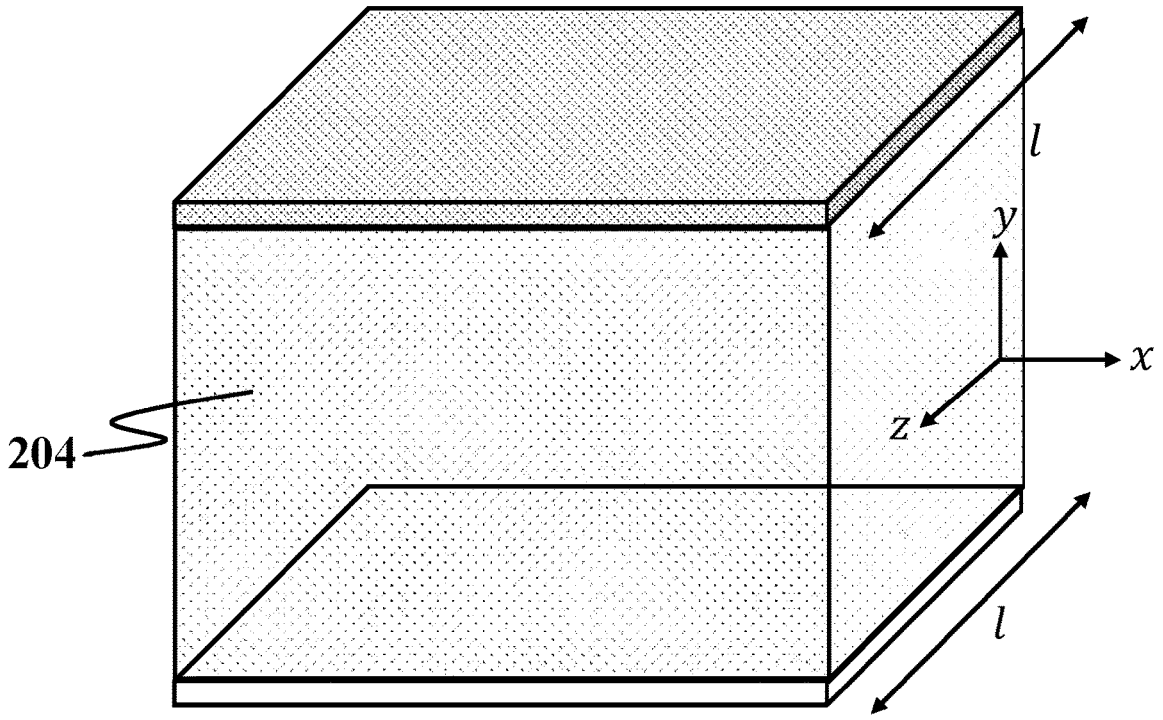
FIG. 2E shows a schematic of an impedance surface parallel-plate waveguide, consistent with one or more exemplary embodiments of the present disclosure.

FIG. 2E shows a schematic of an impedance surface parallel-plate waveguide, consistent with one or more exemplary embodiments of the present disclosure. In an exemplary embodiment, an impedance surface parallel-plate waveguide 202D may be obtained by placing an impedance surface on magneto-dielectric material 204. In an exemplary embodiment, impedance surface parallel-plate waveguide 202D may be an exemplary implementation of parallel-plate waveguide 202B in FIG. 2C. In an exemplary embodiment, parallel-plate waveguide 202B may not include a cutoff frequency in a dominant transverse electromagnetic (TEM) propagation mode. In an exemplary embodiment, placing impedance surface 208 may change a propagation mode of a passing wave in parallel-plate waveguide 202B in FIG. 2C to a TM propagation mode in impedance surface parallel-plate waveguide 202D in FIG. 2E. As a result, a cutoff frequency may be introduced for a dominant TM propagation mode in impedance surface parallel-plate waveguide 202D and impedance surface parallel-plate waveguide 202D may operate as an EMNZ metamaterial in frequencies smaller than the cutoff frequency.

Figure 3A:
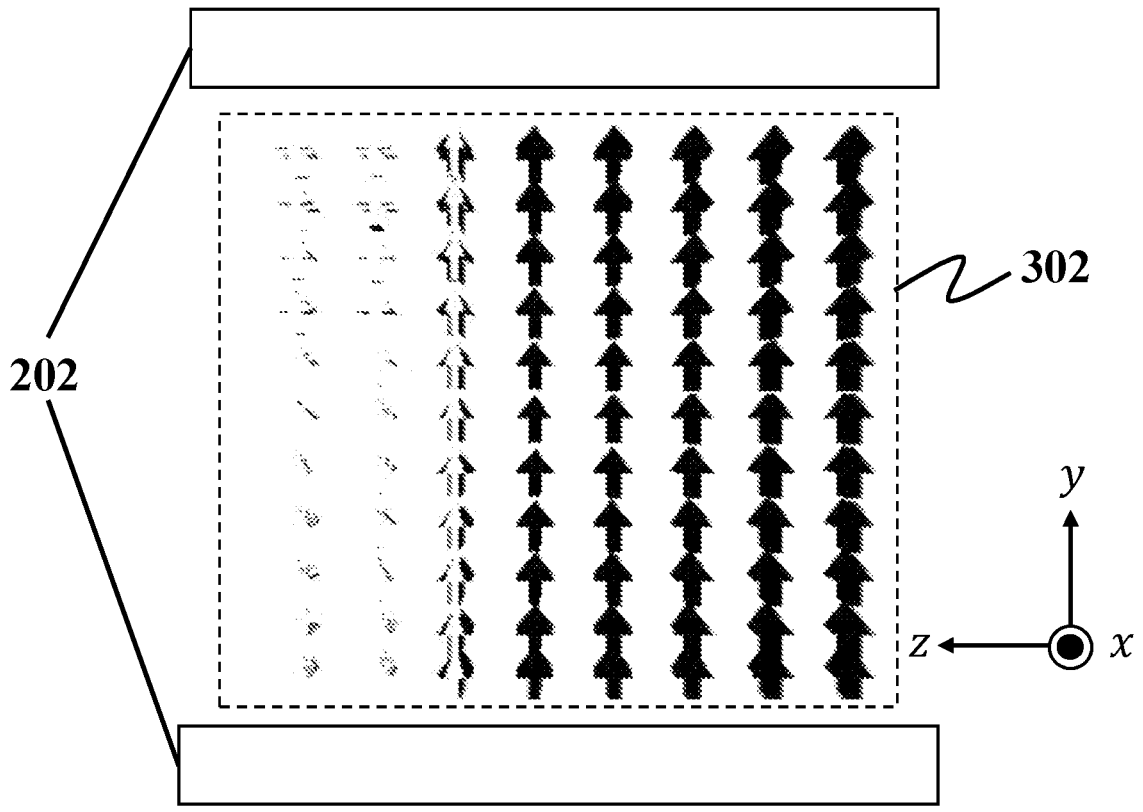
FIG. 3A shows an electric field in a side view of a waveguide, consistent with one or more exemplary embodiments of the present disclosure.

FIG. 3A shows an electric field in a side view of a waveguide, consistent with one or more exemplary embodiments of the present disclosure. In an exemplary embodiment, a first electric field 302 of a passing wave in waveguide 202 may be perpendicular to a direction of propagation, that is, z direction (first electric field 302 is more intense in points with darker electric field arrows). An exemplary passing wave may include a TE propagation mode in waveguide 202 with a cutoff frequency according to Equation (1).

Figure 3B:
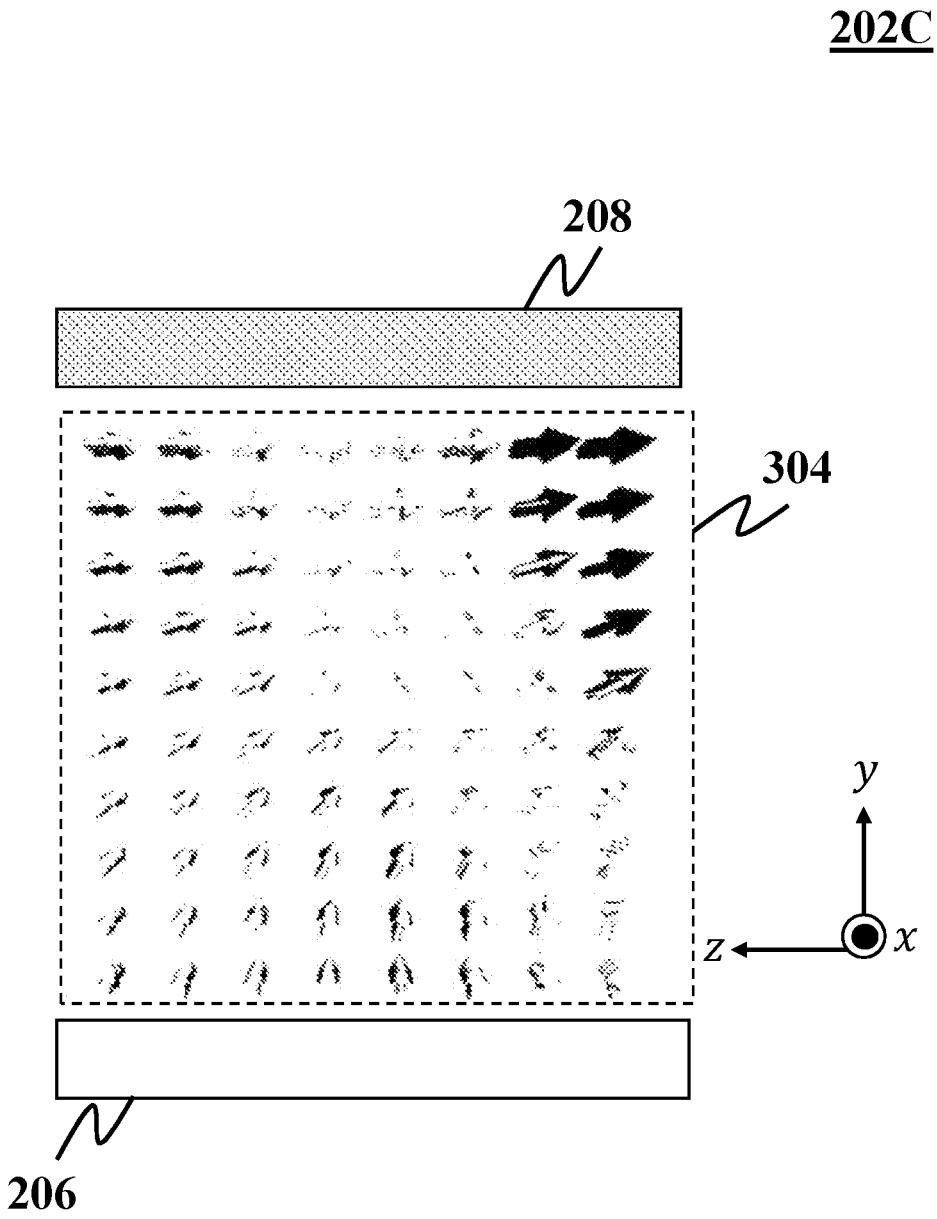
FIG. 3B shows an electric field in a side view of an impedance surface waveguide, consistent with one or more exemplary embodiments of the present disclosure.

FIG. 3B shows an electric field in a side view of an impedance surface waveguide, consistent with one or more exemplary embodiments of the present disclosure. In an exemplary embodiment, placing impedance surface 208 may impose an impedance boundary condition on a passing wave through impedance surface waveguide 202C (shown from a side view in FIG. 2D). As a result, in an exemplary embodiment, a second electric field 304 of a passing wave in impedance surface waveguide 202C may be parallel with impedance surface 208 (second electric field 304 is more intense in points with darker electric field arrows). In an exemplary embodiment, second electric field 304 may not be perpendicular to z direction. In an exemplary embodiment, second electric field 304 may show an electric field of a passing wave in a TM propagation mode. As a result, in an exemplary embodiment, placing impedance surface 208 may change a propagation mode from a TE propagation mode to a TM propagation mode.

Referring again to FIGS. 1A and 2A, in an exemplary embodiment, placing impedance surface 208 in step 106 in FIG. 1A may include placing a tunable impedance surface. An exemplary tunable impedance surface may include a tunable conductivity. An exemplary tunable impedance surface may include an artificial structure imposing an impedance boundary condition on a passing wave. Moreover, a tunable impedance surface may be electrically tuned to exhibit different values of surface impedances. An exemplary tunable impedance surface may be tuned by applying an electric potential to the tunable impedance surface. In an exemplary embodiment, a desired surface impedance of the tunable impedance surface may be obtained by applying an electric potential related to the desired surface impedance. In an exemplary embodiment, a relation between different electric potential values and resulting surface impedances of the tunable impedance surface may be obtained empirically. In an exemplary embodiment, by tuning the tunable impedance surface to each value of surface impedance a respective cutoff frequency of EMNZ metamaterial 200 may be obtained. As a result, in an exemplary embodiment, a cutoff frequency of EMNZ metamaterial 200 may be adjusted by tuning the tunable impedance surface to exhibit a respective surface impedance to the cutoff frequency. In an exemplary embodiment, a relation between different values of surface impedances and respective cutoff frequencies for each surface impedance may be obtained empirically.

Figure 1B:
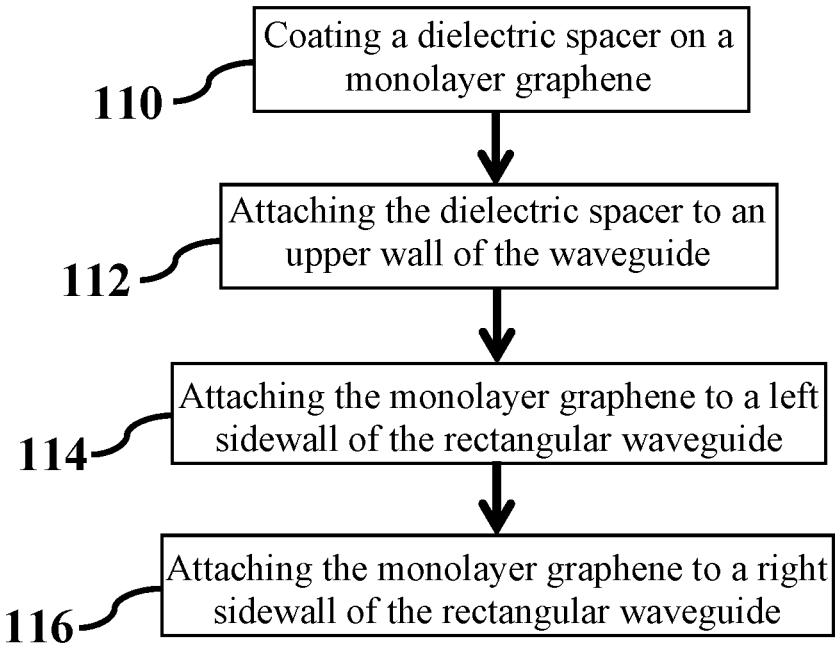
FIG. 1B shows a flowchart of a method for placing a graphene monolayer on a magneto-dielectric material, consistent with one or more exemplary embodiments of the present disclosure.

FIG. 1B shows a flowchart of a method for placing a graphene monolayer on a magneto-dielectric material, consistent with one or more exemplary embodiments of the present disclosure. Specifically, FIG. 1B shows exemplary details of step 106. In an exemplary embodiment, placing the tunable impedance surface on magneto-dielectric material 204 may include placing a graphene monolayer on magneto-dielectric material 204. In an exemplary embodiment, placing the graphene monolayer may include coating a dielectric spacer on the graphene monolayer (step 110), attaching the dielectric spacer to an upper wall of a graphene-loaded waveguide (step 112), attaching graphene monolayer 210 to a left sidewall of the rectangular waveguide (step 114), and attaching graphene monolayer 210 to a right sidewall of the rectangular waveguide (step 116).

Figure 2F:
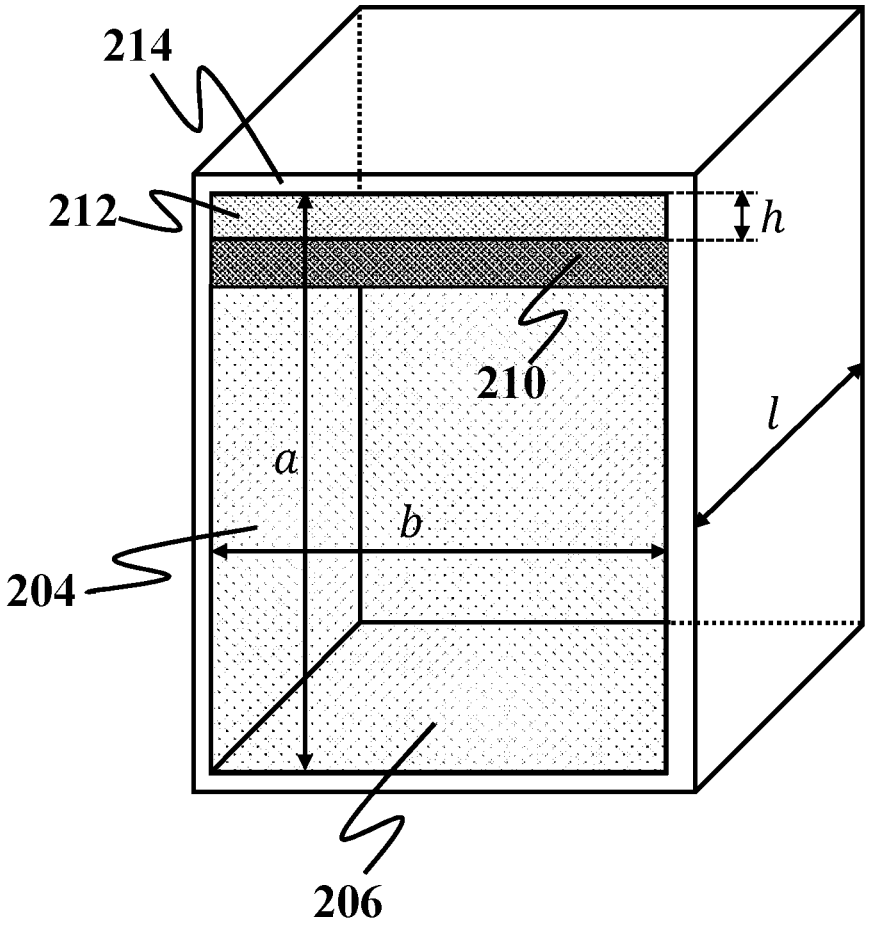
FIG. 2F shows a schematic of a graphene-loaded waveguide, consistent with one or more exemplary embodiments of the present disclosure.

FIG. 2F shows a schematic of a graphene-loaded waveguide, consistent with one or more exemplary embodiments of the present disclosure. In an exemplary embodiment, a graphene-loaded waveguide 202E may include a fourth implementation of waveguide 202. In an exemplary embodiment, different steps of flowchart 106 in FIG. 1B may be implemented utilizing graphene-loaded waveguide 202E. In an exemplary embodiment, graphene-loaded waveguide 202E may include a graphene monolayer 210 and a dielectric spacer 212. In an exemplary embodiment, a permittivity of dielectric spacer 212 may be equal to a permittivity E of magneto-dielectric material 204. In an exemplary embodiment, a permeability of dielectric spacer 212 may be equal to a permeability μ of magneto-dielectric material 204. In an exemplary embodiment, graphene monolayer 210 may exhibit various surface impedances in different frequency bands. In an exemplary embodiment, a surface impedance of graphene monolayer 210 may change a propagation mode to a TM propagation mode in various frequency bands including visible light, terahertz, and gigahertz frequency bands. As a result, graphene-loaded waveguide 202E may exhibit EMNZ characteristic in visible light, terahertz, and gigahertz frequency bands. In an exemplary embodiment, a surface impedance of graphene monolayer 210 may depend on a value of a chemical potential of graphene monolayer 210. As a result, a surface impedance of graphene monolayer 210 may be adjusted by adjusting a chemical potential of graphene monolayer. In an exemplary embodiment, a chemical potential of graphene monolayer 210 may depend on an electric potential applied to graphene monolayer 210. As a result, an exemplary chemical potential of graphene monolayer 210 may be adjusted by adjusting an electric potential applied to graphene monolayer 210. An exemplary electric potential applied to graphene monolayer may include a direct current (DC) electric potential. In an exemplary embodiment, graphene monolayer 210 may exhibit a specific surface impedance by applying a respective electric potential to graphene monolayer 210. An exemplary electric potential may be applied to graphene monolayer 210 by connecting graphene monolayer 210 to a DC power supply node. In an exemplary embodiment, graphene monolayer 210 may include a single atomic layer of graphite. In an exemplary embodiment, when a thickness of graphene monolayer 210 is large, graphene monolayer 210 may turn to a graphene plasmon. As a result, graphene monolayer 210 may not impose an impedance surface boundary condition on a passing wave in graphene-loaded waveguide 202E, and consequently, graphene-loaded waveguide 202E may not exhibit EMNZ characteristics.

Referring again to FIGS. 1B and 2F, in an exemplary embodiment, step 110 in FIG. 1B may include coating a dielectric spacer 212 on a graphene monolayer 210. In an exemplary embodiment, coating dielectric spacer 212 may include determining a thickness h FIG. 2F of dielectric spacer 212. In an exemplary embodiment, the thickness h may be determined based on a thickness condition defined by $h \leq \lambda/4$. In an exemplary embodiment, when thickness h is large compared with operating wavelength λ, a combination of graphene monolayer 210 and dielectric spacer 212 may not impose an impedance surface boundary condition, and consequently, a propagation mode may not change to a TM mode. As a result, in an exemplary embodiment, graphene-loaded waveguide 202E may not exhibit EMNZ characteristics.

In an exemplary embodiment, step 112 in FIG. 1B may include directly attaching dielectric spacer 212 to an upper wall 214 of graphene-loaded waveguide 202E in FIG. 2F. As a result, in an exemplary embodiment, dielectric spacer 212 may be positioned between upper wall 214 and graphene monolayer 210. Otherwise, in an exemplary embodiment, graphene monolayer 210 may be short-circuited with upper wall 214. As a result, graphene monolayer 210 may not impose an impedance surface boundary condition on a passing wave in graphene-loaded waveguide 202E. In an exemplary embodiment, dielectric spacer 212 may avoid graphene monolayer 210 to be short-circuited with upper wall 214.

Figure 2G:
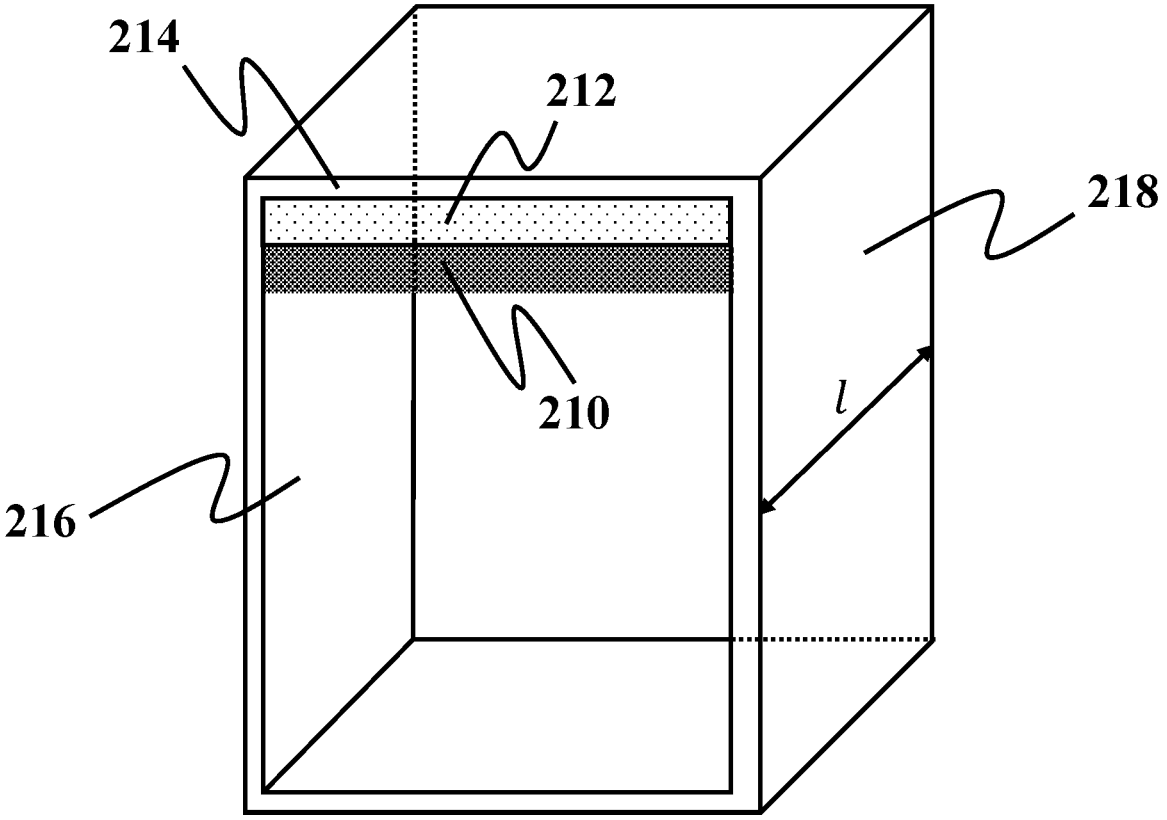
FIG. 2G shows a schematic of a graphene-loaded rectangular waveguide, consistent with one or more exemplary embodiments of the present disclosure.

FIG. 2G shows a schematic of a graphene-loaded rectangular waveguide, consistent with one or more exemplary embodiments of the present disclosure. In an exemplary embodiment, a graphene-loaded rectangular waveguide 202F may include an exemplary implementation of graphene-loaded waveguide 202E. In an exemplary embodiment, different steps of flowchart 106 in FIG. 1B may be implemented utilizing graphene-loaded rectangular waveguide 202F. In an exemplary embodiment, step 114 in FIG. 1B may include directly attaching graphene monolayer 210 to a left sidewall 216 of graphene-loaded rectangular waveguide 202F. In an exemplary embodiment, an impedance surface boundary condition may be imposed on a passing wave over entire of upper wall 214. As a result, graphene monolayer 210 may cover entire of upper wall 214. In an exemplary embodiment, graphene monolayer 210 may be directly attached to left sidewall 216 to ensure imposing the impedance surface boundary condition over entire of upper wall 214.

Referring again to FIGS. 1B and 2G, in an exemplary embodiment, step 116 in FIG. 1B may include directly attaching graphene monolayer 210 to a right sidewall 218 of graphene-loaded rectangular waveguide 202F. In an exemplary embodiment, an impedance surface boundary condition may be imposed on a passing wave over entire of upper wall 214. As a result, graphene monolayer 210 may cover entire of upper wall 214. In an exemplary embodiment, graphene monolayer 210 may be directly attached to right sidewall 218 to ensure imposing the impedance surface boundary condition over entire of upper wall 214.

In an exemplary embodiment, step 108 in FIG. 1A may include adjusting cutoff frequency $f_c$. In an exemplary embodiment, the cutoff frequency may be adjusted by adjusting a chemical potential $\mu_c$ of graphene monolayer 210. An exemplary chemical potential may be adjusted according to an operation defined by:

$$f_c = \frac{1}{4a\sqrt{\mu\epsilon_{eff}}} \qquad \text{Equation (2)}$$

where a is a distance between upper wall 214 and lower wall 206, μ is the permeability of the magneto-dielectric material and $\epsilon_{eff}$ is an effective permittivity of magneto-dielectric material 204 and graphene monolayer 210, where $\epsilon_{eff}=\epsilon(1-$ $165\sqrt{a}\mu_c$). In an exemplary embodiment, chemical potential $\mu_c$ of graphene monolayer 210 may be adjusted by applying a respective DC electric potential to graphene monolayer 210. In an exemplary embodiment, a relation between chemical potential $\mu_c$ of graphene monolayer 210 and a respective DC electric potential may be obtained empirically.

Figure 4A:
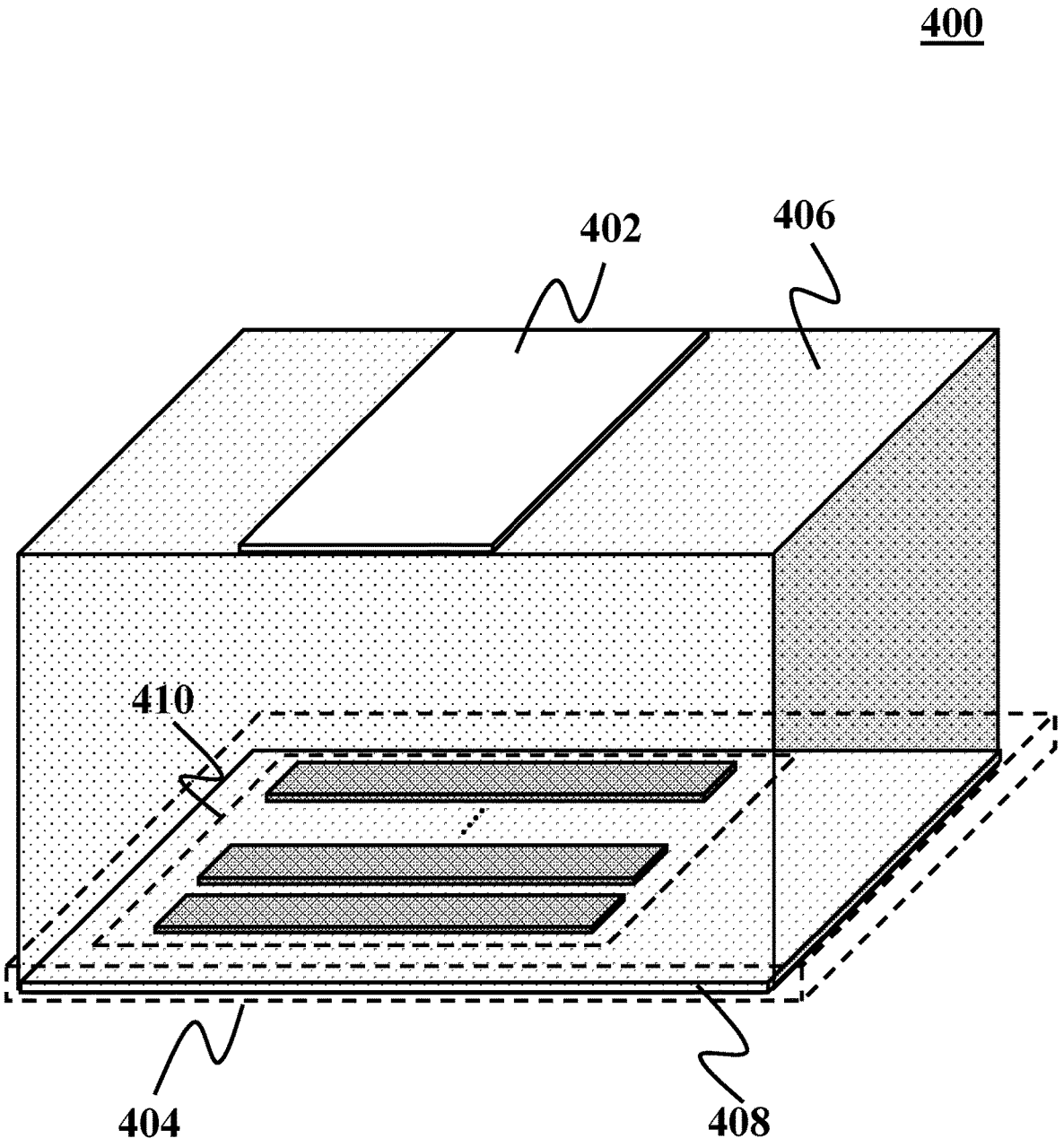
FIG. 4A shows a schematic of a metamaterial switch, consistent with one or more exemplary embodiments of the present disclosure.

FIG. 4A shows a schematic of a metamaterial switch, consistent with one or more exemplary embodiments of the present disclosure. In an exemplary embodiment, metamaterial switch 400 may include a first conductive plate 402, a first loaded conductive plate 404, and a magneto-dielectric material 406. In an exemplary embodiment, first loaded conductive plate 404 may include a second conductive plate 408 and a first tunable impedance surface set 410. In an exemplary embodiment, second conductive plate 408 may be parallel with first conductive plate 402. In an exemplary embodiment, each tunable impedance surface in first tunable impedance surface set 410 may include a respective tunable conductivity. In an exemplary embodiment, first tunable impedance surface set 410 may be positioned between first conductive plate 402 and second conductive plate 408. In an exemplary embodiment, magneto-dielectric material 406 may be deposited on first loaded conductive plate 404. In an exemplary embodiment, an effective permittivity of metamaterial switch 400 may be configured to be adjusted to a first predetermined value. In an exemplary embodiment, the effective permittivity of metamaterial switch 400 may be adjusted responsive to tuning a respective tunable conductivity of each respective tunable impedance surface in first tunable impedance surface set 410.

In an exemplary embodiment, when the first predetermined value is near-zero, adjusting the effective permittivity of metamaterial switch 400 may result in a near-zero effective permittivity of metamaterial switch 400. As a result, a microwave signal may be blocked by metamaterial switch 400 due to a near-zero effective permittivity metamaterial switch 400. In other words, metamaterial switch 400 may be configured to be opened when the first predetermined value is near-zero. In contrast, in an exemplary embodiment, when the first predetermined value is a positive value, adjusting the effective permittivity of metamaterial switch 400 may result in a positive effective permittivity of metamaterial switch 400. As a result, a microwave signal may pass through metamaterial switch 400 due to a positive effective permittivity of metamaterial switch 400. In other words, metamaterial switch 400 may be configured to be closed when the first predetermined value is positive.

In an exemplary embodiment, metamaterial switch 400 may be implemented utilizing a microstrip. An exemplary microstrip may include a strip conductor and a ground plane. An exemplary strip conductor of the microstrip may include first conductive plate 402. An exemplary ground plane of the microstrip may include second conductive plate 408.

In an exemplary embodiment, metamaterial switch 400 may be configured to be closed by setting a respective tunable conductivity of each tunable impedance surface in first tunable impedance surface set 410 larger than a conductivity threshold. In an exemplary embodiment, increasing a conductivity of a tunable impedance surface may increase the effective permittivity of metamaterial switch 400. As a result, a microwave signal may pass through a medium with large effective permittivity, that is, metamaterial switch 400 is closed. In an exemplary embodiment, metamaterial switch 400 may be further configured to be opened by setting a respective tunable conductivity of each tunable impedance surface in first tunable impedance surface set 410 smaller than the conductivity threshold. In an exemplary embodiment, decreasing a conductivity of a tunable impedance surface may decrease the effective permittivity of metamaterial switch 400. As a result, a microwave signal may be blocked by a medium with small effective permittivity, that is, metamaterial switch 400 is opened.

Figure 4B:
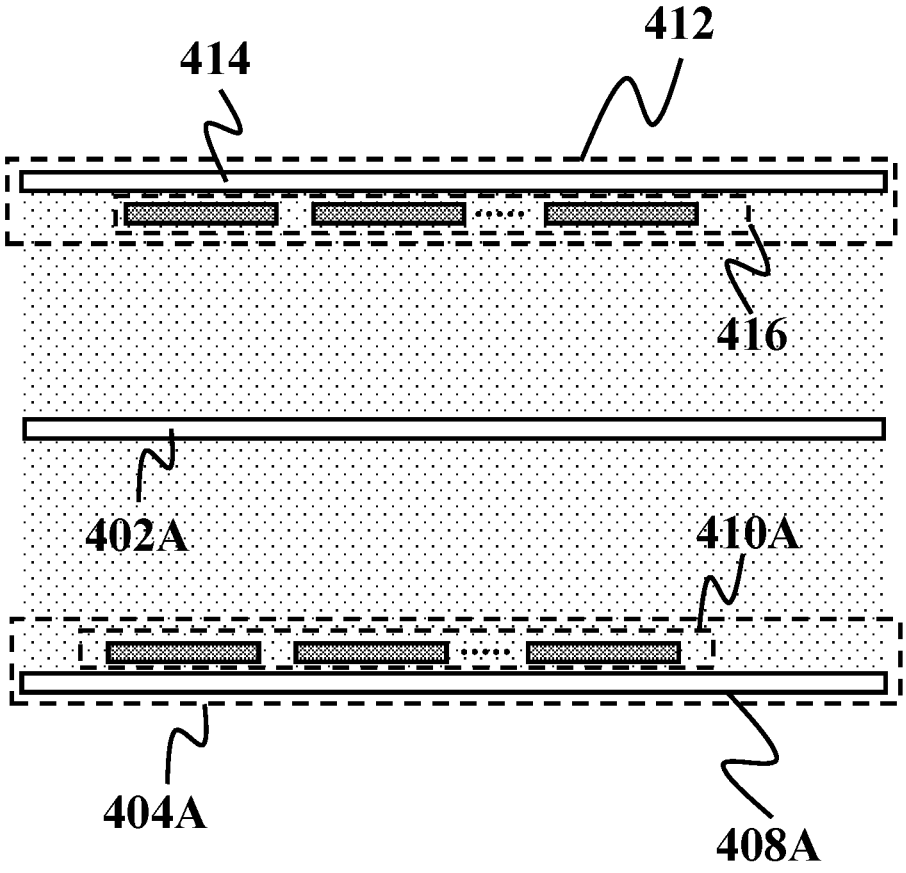
FIG. 4B shows a schematic of a side view of a metamaterial switch, consistent with one or more exemplary embodiments of the present disclosure.

FIG. 4B shows a schematic of a side view of a metamaterial switch, consistent with one or more exemplary embodiments of the present disclosure. In an exemplary embodiment, stripline metamaterial switch 400A may include an implementation of metamaterial switch 400. In an exemplary embodiment, stripline metamaterial switch 400A may include a second loaded conductive plate 412. In an exemplary embodiment, second loaded conductive plate 412 may include a third conductive plate 414 and a second tunable impedance surface set 416. In an exemplary embodiment, third conductive plate 414 may be parallel with a second conductive plate 408A. In an exemplary embodiment, second conductive plate 408A may include an implementation of second conductive plate 408 in FIG. 4A. In an exemplary embodiment, each tunable impedance surface in second tunable impedance surface set 416 may include a respective tunable conductivity. In an exemplary embodiment, second tunable impedance surface set 416 may be positioned between a first conductive plate 402A and third conductive plate 414. In an exemplary embodiment, first conductive plate 402A may include an implementation of first conductive plate 402A. In an exemplary embodiment, first conductive plate 402A may be positioned between a first loaded conductive plate 404A and second loaded conductive plate 412. In an exemplary embodiment, first loaded conductive plate 404A may include an implementation of first loaded conductive plate 404 in FIG. 4A. In an exemplary embodiment, an effective permittivity of stripline metamaterial switch 400A is configured to be adjusted to a second predetermined value. In an exemplary embodiment, the effective permittivity of stripline metamaterial switch 400A may be adjusted responsive to tuning a respective tunable conductivity of each respective tunable impedance surface in second tunable impedance surface set 416. In an exemplary embodiment, when the second predetermined value is near-zero, adjusting the effective permittivity of stripline metamaterial switch 400A may result in a near-zero effective permittivity of stripline metamaterial switch 400A. As a result, a microwave signal may be blocked by stripline metamaterial switch 400A due to a near-zero effective permittivity stripline metamaterial switch 400A. In other words, stripline metamaterial switch 400A may be configured to be opened when the second predetermined value is near-zero. In contrast, in an exemplary embodiment, when the second predetermined value is a positive value, adjusting the effective permittivity of stripline metamaterial switch 400A may result in a positive effective permittivity of stripline metamaterial switch 400A. As a result, a microwave signal may pass through stripline metamaterial switch 400A due to a positive effective permittivity of stripline metamaterial switch 400A. In other words, metamaterial switch 400 may be configured to be closed when the second predetermined value is positive.

In an exemplary embodiment, stripline metamaterial switch 400A may be implemented utilizing a stripline. An exemplary stripline may include a strip conductor, a first ground plane, and a second ground plane. An exemplary strip conductor of the stripline may include first conductive plate 402A. An exemplary first ground plane of the stripline may include second conductive plate 408A. An exemplary second ground plane of the stripline may include third conductive plate 414.

In an exemplary embodiment, a respective tunable conductivity of each tunable impedance surface in second tunable impedance surface set 416 may be equal to a respective tunable conductivity of each respective tunable impedance surface in a first tunable impedance surface set 410A. In an exemplary embodiment, first tunable impedance surface set 410A may include an implementation of first tunable impedance surface set 410 in FIG. 4A.

In an exemplary embodiment, each tunable impedance surface in first tunable impedance surface set 410 in FIG. 4A may include a respective graphene monolayer of a graphene monolayer set. In an exemplary embodiment, each tunable impedance surface in second tunable impedance surface set 416 may include a respective graphene monolayer of the graphene monolayer set.

In an exemplary embodiment, a respective tunable conductivity of each tunable impedance surface in each of first tunable impedance surface set 410 in FIG. 4A and second tunable impedance surface set 416 may be configured to be set larger than the conductivity threshold by applying a first electric potential to each respective graphene monolayer in the graphene monolayer set. In an exemplary embodiment, a respective tunable conductivity of each tunable impedance surface in each of first tunable impedance surface set 410 in FIG. 4A and second tunable impedance surface set 416 may be configured to be set smaller than the conductivity threshold by applying a second electric potential to each respective graphene monolayer in the graphene monolayer set.

Figure 4C:
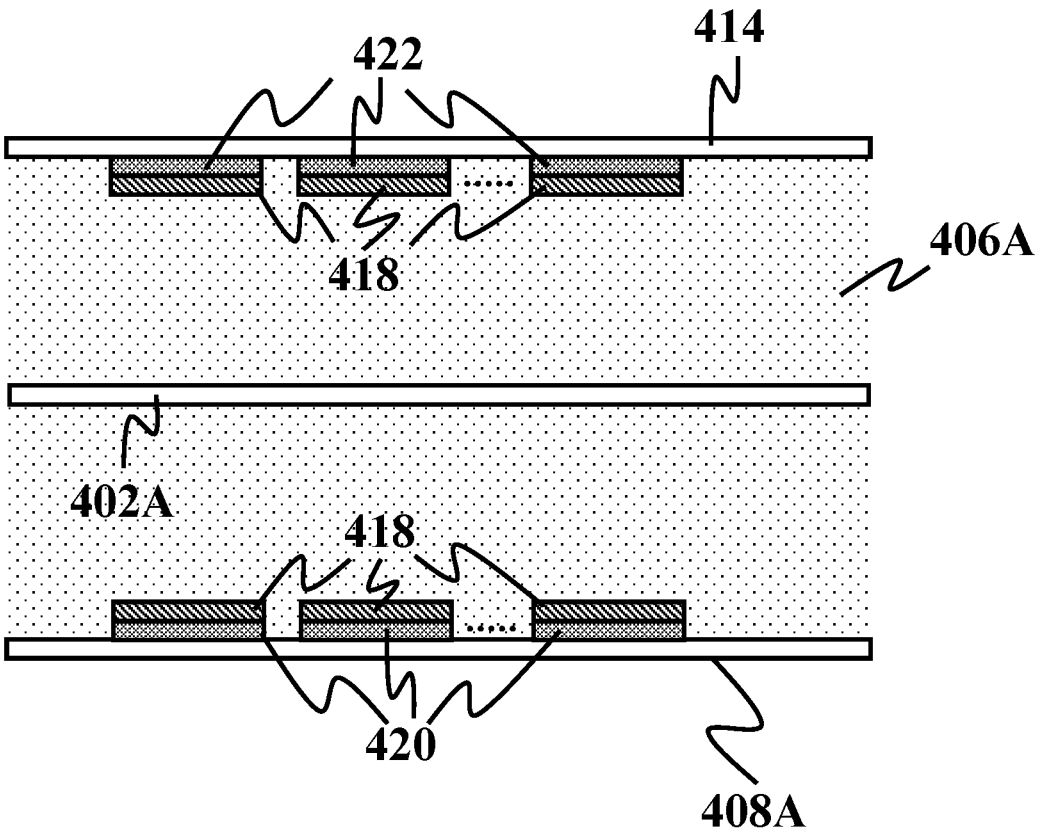
FIG. 4C shows a schematic of a side view of a graphene-loaded metamaterial switch, consistent with one or more exemplary embodiments of the present disclosure.

FIG. 4C shows a schematic of a side view of a graphene-loaded metamaterial switch, consistent with one or more exemplary embodiments of the present disclosure. In an exemplary embodiment, stripline metamaterial switch 400A may further include a first dielectric spacer set 420 and a second dielectric spacer set 422. In an exemplary embodiment, each dielectric spacer in first dielectric spacer set 420 may be coated on a respective graphene monolayer in a graphene monolayer set 418. In an exemplary embodiment, each dielectric spacer in first dielectric spacer set 420 may be attached to second conductive plate 408A. In an exemplary embodiment, a thickness of each dielectric spacer in first dielectric spacer set 420 may be equal to or smaller than a quarter of an operating wavelength of stripline metamaterial switch 400A. In an exemplary embodiment, a permittivity of each dielectric spacer in first dielectric spacer set 420 may be equal to a permittivity of a magneto-dielectric material 406A. In an exemplary embodiment, magneto-dielectric material 406A may be an implementation of magneto-dielectric material 406. In an exemplary embodiment, a permeability of each dielectric spacer in first dielectric spacer set 420 may be equal to a permeability of magneto-dielectric material 406A.

In an exemplary embodiment, each dielectric spacer in second dielectric spacer set 422 may be coated on a respective graphene monolayer in graphene monolayer set 418. In an exemplary embodiment, each dielectric spacer in second dielectric spacer set 422 may be attached to third conductive plate 414. In an exemplary embodiment, a thickness of each dielectric spacer in second dielectric spacer set 422 may be equal to or smaller than a quarter of the operating wavelength. In an exemplary embodiment, a permittivity of each dielectric spacer in second dielectric spacer set 422 may be equal to the permittivity of magneto-dielectric material 406A. In an exemplary embodiment, a permeability of each dielectric spacer in second dielectric spacer set 422 may be equal to a permeability of magneto-dielectric material 422.

An exemplary length of each impedance surface in metamaterial switch 400 may impact an insertion loss of metamaterial switch 400. In an exemplary embodiment, different lengths of impedance surfaces may result in different cutoff frequency of a metamaterial implemented by a guided structure and impedance surfaces. In other words, different lengths of impedance surfaces may result in different cutoff frequencies in a wide frequency range. As a result, utilizing a set of impedances with various lengths may provide a wideband metamaterial switch. In an exemplary embodiment, a length of each impedance surface in each of first tunable impedance surface set 410 and second tunable impedance surface set 416 may satisfy one of a first length condition, a second length condition, a third length condition, and a fourth length condition.

Figure 5A:
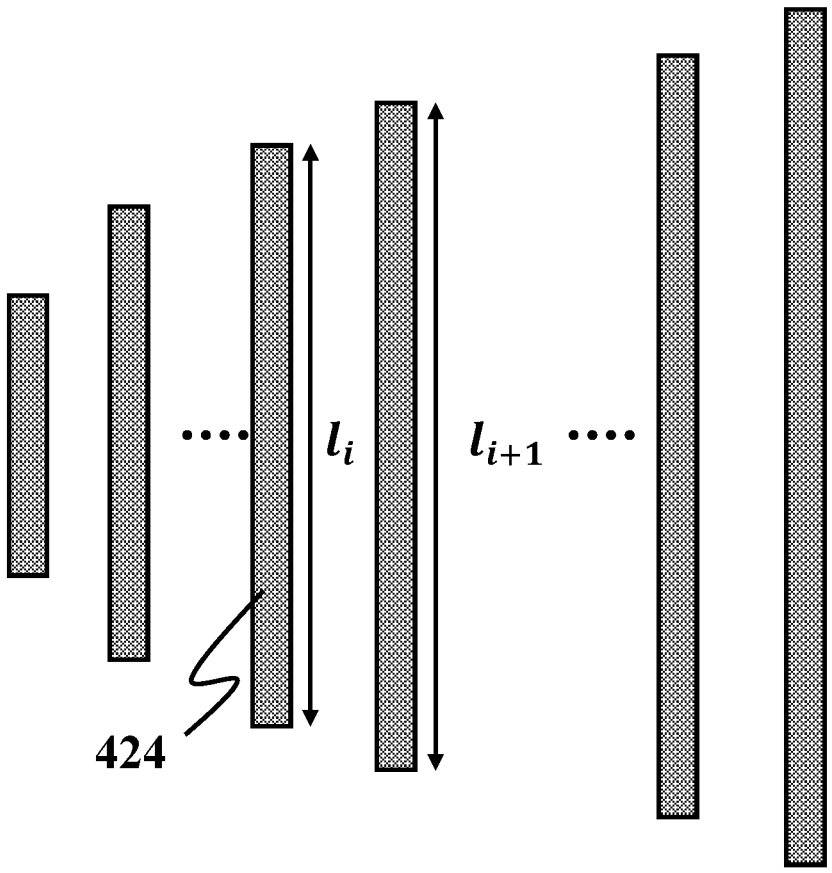
FIG. 5A shows a schematic of a tunable impedance surface set satisfying a first condition, consistent with one or more exemplary embodiments of the present disclosure.

FIG. 5A shows a schematic of a tunable impedance surface set satisfying a first condition, consistent with one or more exemplary embodiments of the present disclosure. An exemplary first length condition may include $l_i<l_{i+1}$, where $l_i$ is a length of an $i^{th}$ tunable impedance surface 424 in each of first tunable impedance surface set 410 and the second tunable impedance surface set 416, $1\leq i\leq N-1$, and N is a size of each of first tunable impedance surface set 410 and second tunable impedance surface set 416. In an exemplary embodiment, lengths of tunable impedance surfaces in first tunable impedance surface set 410 may be arranged in an increasing order. In an exemplary embodiment, since an arrangement of tunable impedance surfaces in first tunable impedance surface set 410 may not be symmetrical with respect to an input line and an output line of metamaterial switch 400, metamaterial switch 400 may not be reciprocal, that is, the insertion loss of metamaterial switch 400 from the input line from the output line may not be equal to the insertion loss of metamaterial switch 400 from the output line from the input line.

Figure 5B:
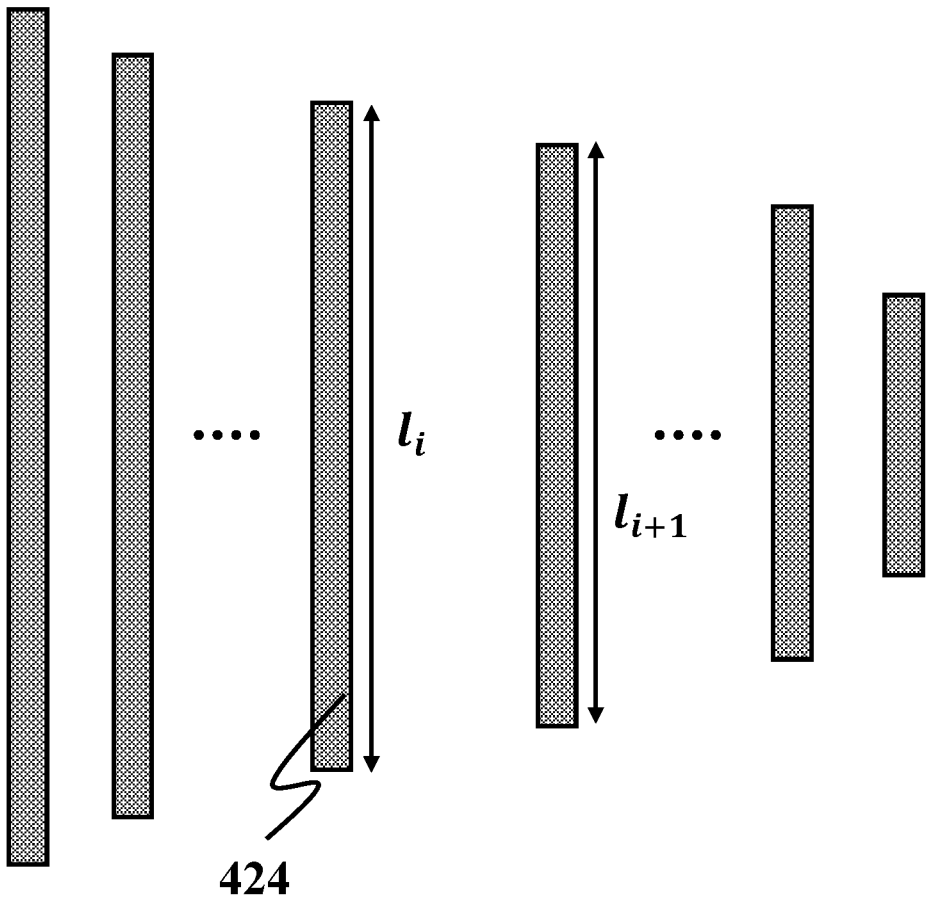
FIG. 5B shows a schematic of a tunable impedance surface set satisfying a second condition, consistent with one or more exemplary embodiments of the present disclosure.

FIG. 5B shows a schematic of a tunable impedance surface set satisfying a second condition, consistent with one or more exemplary embodiments of the present disclosure. An exemplary second length condition may include $l_i>l_{i+1}$. In an exemplary embodiment, similar to the first length condition, metamaterial switch 400 may not be reciprocal when lengths of tunable impedance surfaces in first tunable impedance surface set 410 may be arranged in a decreasing order.

Figure 5C:
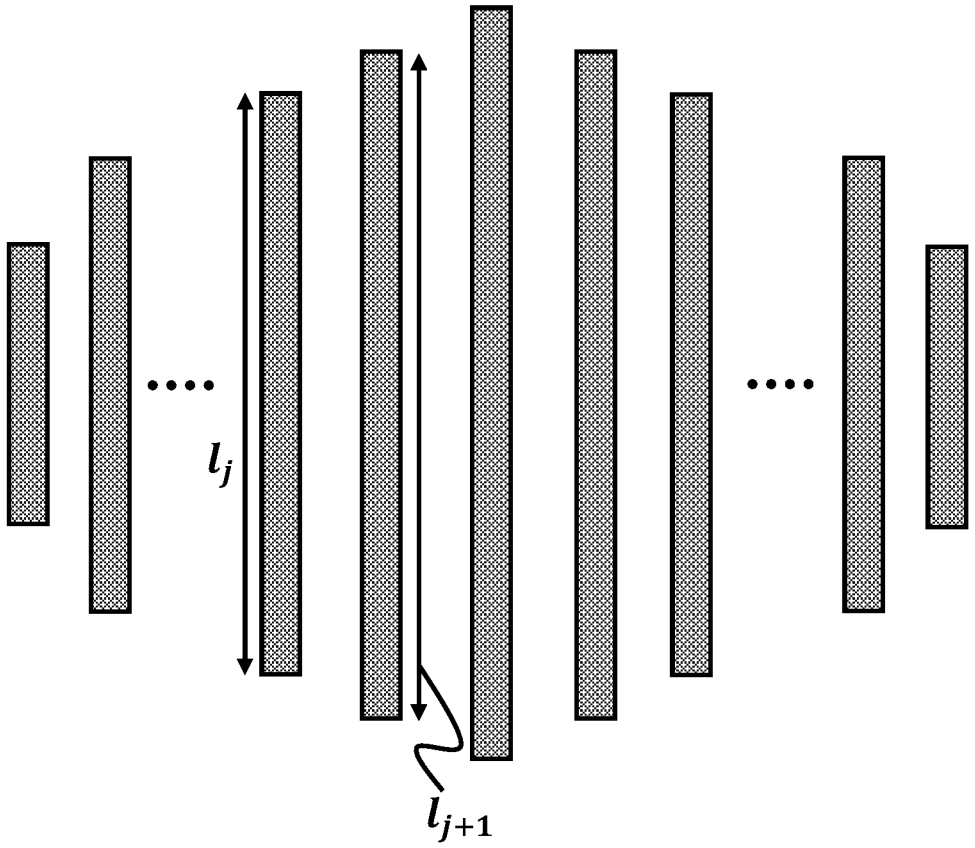
FIG. 5C shows a schematic of a tunable impedance surface set satisfying a third length condition, consistent with one or more exemplary embodiments of the present disclosure.

FIG. 5C shows a schematic of a tunable impedance surface set satisfying a third length condition, consistent with one or more exemplary embodiments of the present disclosure. An exemplary third length condition may include $$l_j < l_{j+1} \text{ and } l_{\left\lfloor \frac{N+1}{2}+k \right\rfloor} = l_{\left\lfloor \frac{N+1}{2}-k \right\rfloor}, \text{ where } 1 \leq j \leq \left\lceil \frac{N}{2} \right\rceil, 1 \leq k \leq \left\lfloor \frac{N}{2} \right\rfloor,$$

$\lfloor\cdot\rfloor$ is a floor operator, and $\lceil\cdot\rceil$ is a ceiling operator. In an exemplary embodiment, when lengths of tunable impedance surfaces in first tunable impedance surface set 410 satisfy the third condition, an arrangement of tunable impedance surfaces in first tunable impedance surface set 410 may be symmetrical with respect to the input line and the output line of metamaterial switch 400. As a result, metamaterial switch 400 may be reciprocal, that is, the insertion loss of metamaterial switch 400 from the input line from the output line may be equal to the insertion loss of metamaterial switch 400 from the output line from the input line.

Figure 5D:
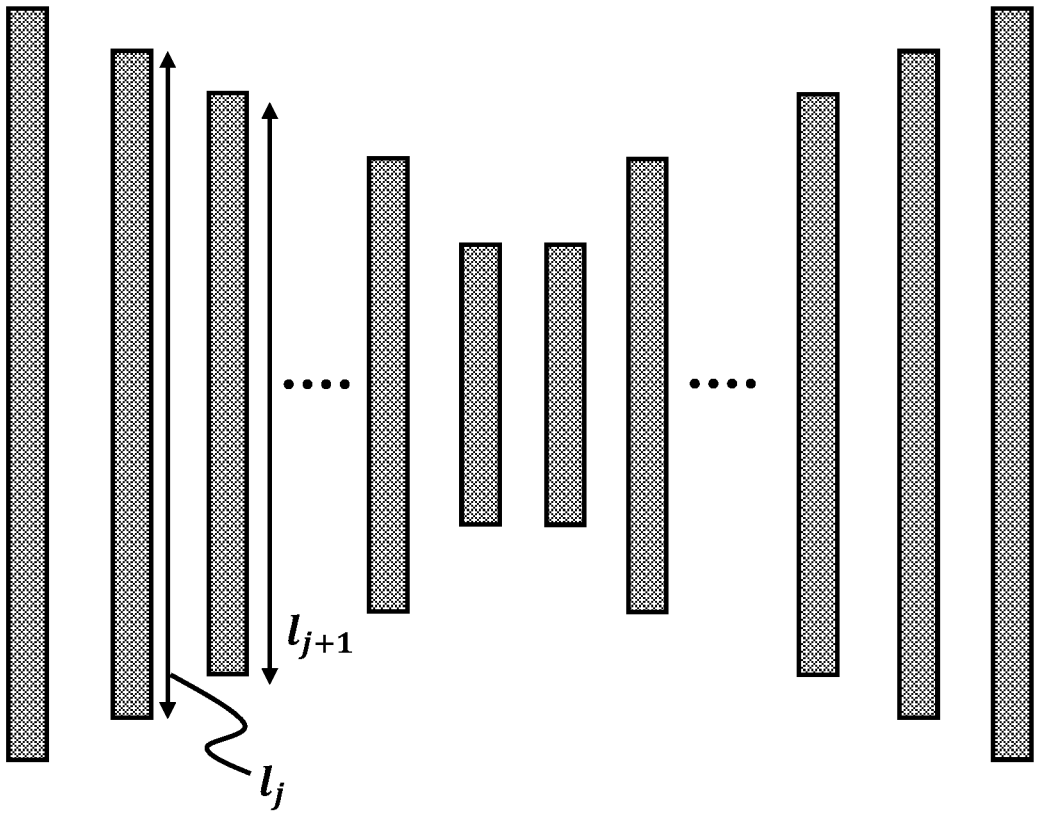
FIG. 5D shows a schematic of a tunable impedance surface set satisfying a fourth length condition, consistent with one or more exemplary embodiments of the present disclosure.

FIG. 5D shows a schematic of a tunable impedance surface set satisfying a fourth length condition, consistent with one or more exemplary embodiments of the present disclosure. An exemplary fourth length condition may include $$l_j > l_{j+1} \text{ and } l_{\left\lfloor \frac{N+1}{2}+k \right\rfloor} = l_{\left\lfloor \frac{N+1}{2}-k \right\rfloor}.$$

In an exemplary embodiment, similar to the third condition, an arrangement of tunable impedance surfaces in first tunable impedance surface set 410 may be symmetrical with respect to the input line and the output line of metamaterial switch 400. As a result, metamaterial switch 400 may be reciprocal when lengths of tunable impedance surfaces in first tunable impedance surface set 410 satisfy the fourth condition.

Figure 4D:
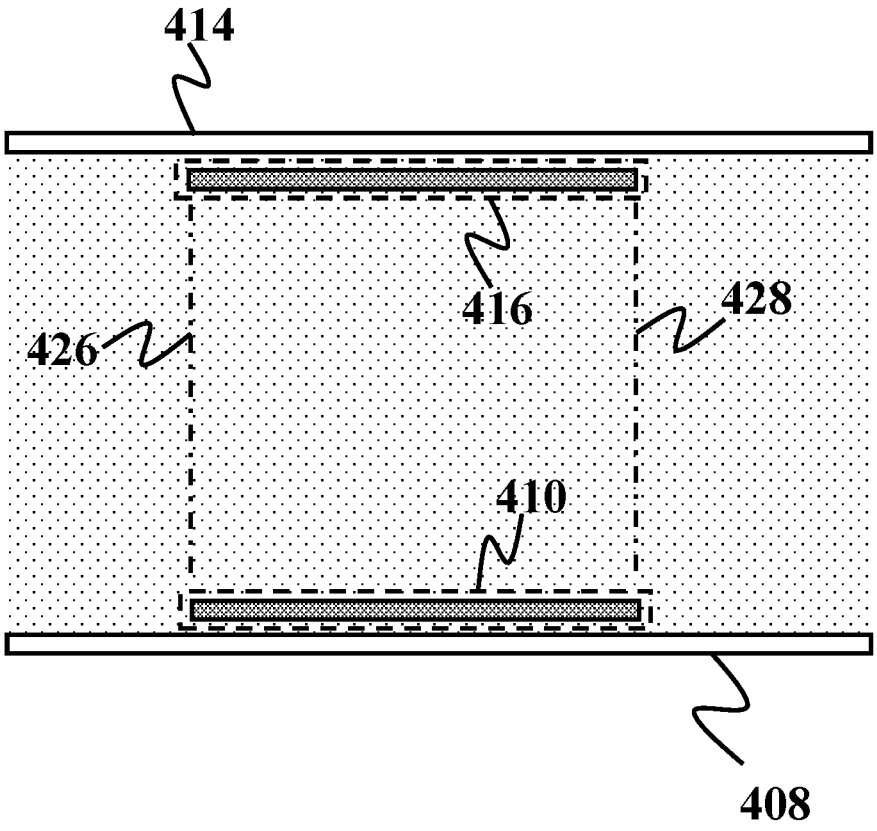
FIG. 4D shows a schematic of a front view of a metamaterial switch, consistent with one or more exemplary embodiments of the present disclosure.

FIG. 4D shows a schematic of a front view of a metamaterial switch, consistent with one or more exemplary embodiments of the present disclosure. In an exemplary embodiment, first conductive plate 402 may be positioned between a respective proximal end 426 and a respective distal end 428 of each respective tunable impedance surface in each of first tunable impedance surface set 410 and second tunable impedance surface set 416. In an exemplary embodiment, when first conductive plate 402 is not positioned between proximal end 426 and distal end 428, an effective permittivity of metamaterial switch 400 may not be near-zero, and consequently, an isolation of metamaterial switch 400 may be small when metamaterial switch 400 is configured to be open.

Figure 6A:
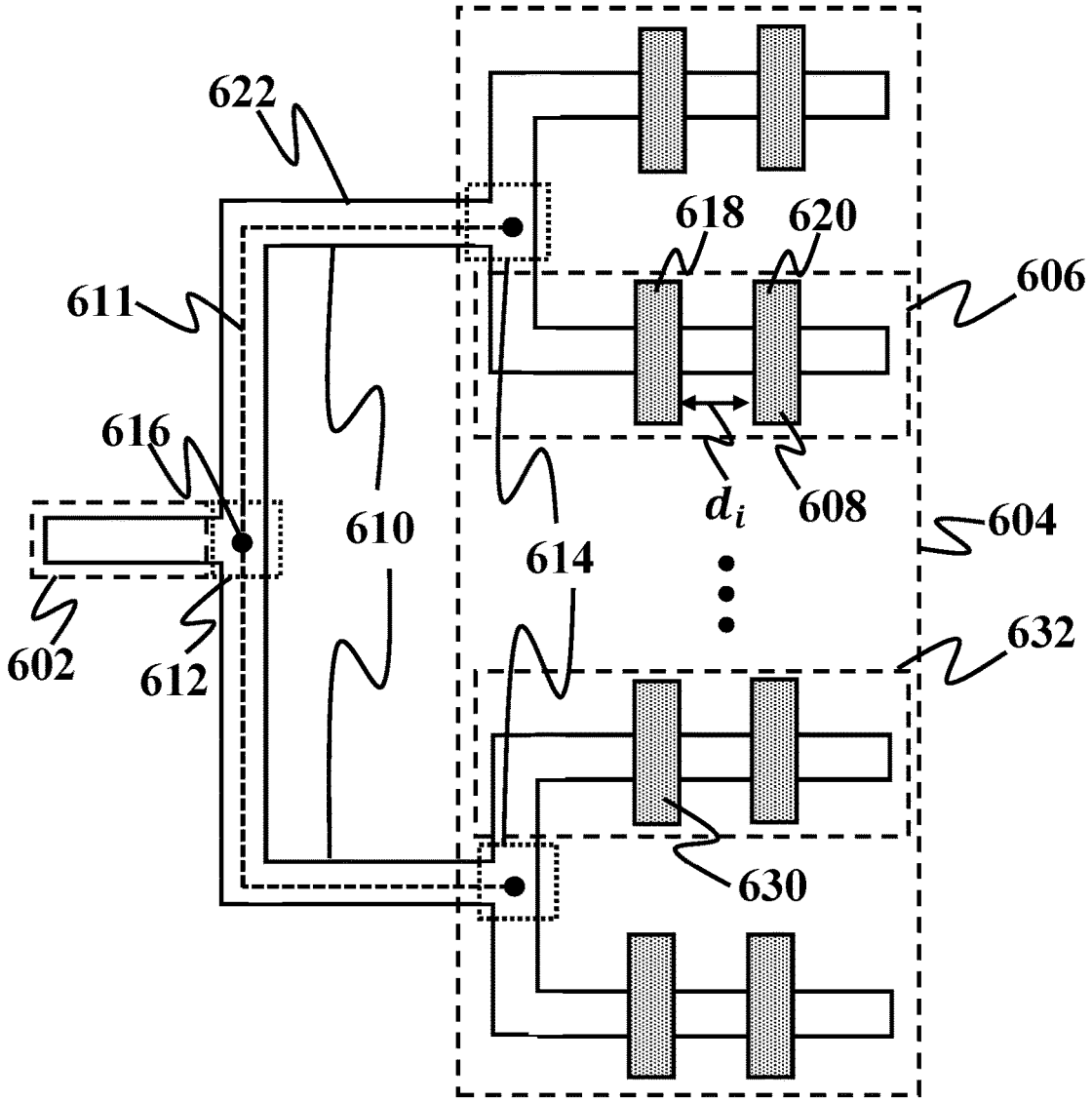
FIG. 6A shows a schematic of a top view of a metamaterial multiplexer, consistent with one or more exemplary embodiments of the present disclosure.

FIG. 6A shows a schematic of a top view of a metamaterial multiplexer, consistent with one or more exemplary embodiments of the present disclosure. In an exemplary embodiment, a metamaterial multiplexer 600 may include an input line 602 and a plurality of output lines 604. In an exemplary embodiment, an $i^{th}$ output line 606 of plurality of output lines 604 may include an $(i, k)^{th}$ metamaterial switch 608, where $1 \leq i \leq N$, $k \in \{1,2\}$, and N is a number of plurality of output lines 604. In an exemplary embodiment, $(i, k)^{th}$ metamaterial switch 608 may be configured to route a microwave signal from input line 602 to $i^{th}$ output line 606. In an exemplary embodiment, $(i, k)^{th}$ metamaterial switch 608 may route the microwave signal responsive to $(i, k)^{th}$ metamaterial switch 608 being closed. In an exemplary embodiment, $(i, k)^{th}$ metamaterial switch 608 may be similar to one of metamaterial switch 400 and stripline metamaterial switch 400A.

In an exemplary embodiment, metamaterial multiplexer 600 may further include a plurality of power splitters and a plurality of transmission lines 610. An exemplary power splitter of the plurality of power splitters may divide a power of the microwave signal to a set of transmission lines that are connected to the power splitter. An exemplary transmission line of plurality of transmission lines 610 may be implemented utilizing one of a microstrip and a stripline. In an exemplary embodiment, each of the plurality of power splitters may be placed on a respective node of a plurality of nodes. In an exemplary embodiment, the plurality of nodes may form a graph 611. In an exemplary embodiment, the plurality of power splitters may include a root power splitter 612 and a plurality of branching power splitters 614. In an exemplary embodiment, root power splitter 612 may be connected to input line 602 and placed on a root node 616 of the graph. In an exemplary embodiment, each branching power splitter of plurality of branching power splitters 614 may be connected to a respective output line of plurality of output lines 604 and placed on a respective branching node of graph 611. In an exemplary embodiment, each of plurality of transmission lines 610 placed on a respective edge of graph 611.

In an exemplary embodiment, a distance $d_i$ between an $(i, 1)^{th}$ metamaterial switch 618 and an $(i, 2)^{th}$ metamaterial switch 620 of $i^{th}$ output line 606 satisfies a condition according to $$\left| d_i - \frac{\lambda_g}{4} \right| \leq \frac{\lambda_g}{20},$$

where $\lambda_g$ is a guided wavelength of the microwave signal. Starting from an open circuit transmission line, a short circuit transmission line may be achieved one-quarter wavelength away. In contrast, starting from a short circuit transmission line, an open circuit mission line may be achieved one-quarter wavelength away. As a result, in an exemplary embodiment, distance $d_i$ may be set to $$\frac{\lambda_g}{4}$$

to increase an isolation of metamaterial multiplexer 600.

Figure 6B:
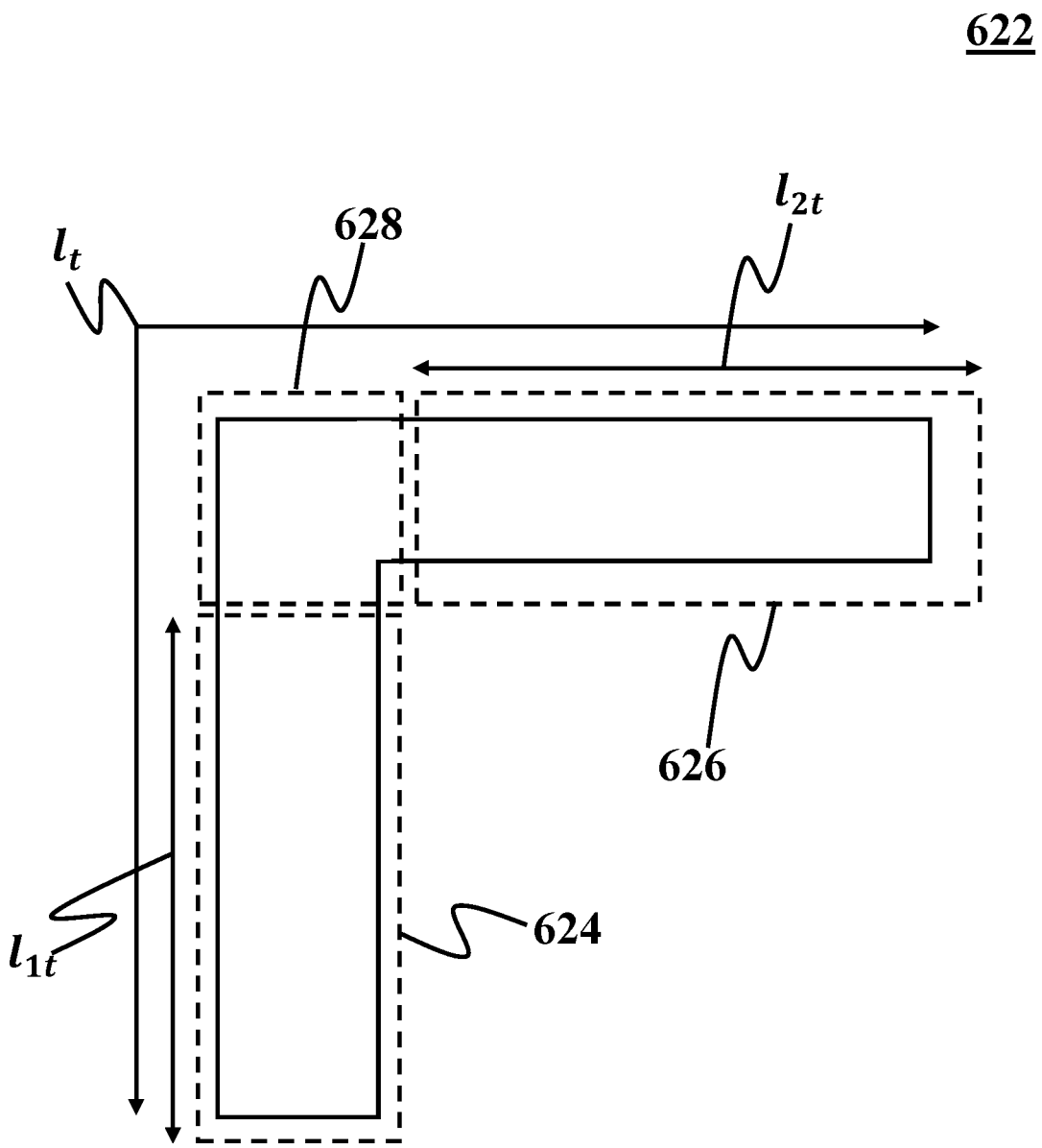
FIG. 6B shows a schematic of a transmission line, consistent with one or more exemplary embodiments of the present disclosure.

FIG. 6B shows a schematic of a transmission line, consistent with one or more exemplary embodiments of the present disclosure. In an exemplary embodiment, a transmission line 622 of plurality of transmission lines 610 may include a first transmission line segment 624, a second transmission line segment 626, and a transmission line bend 628. In an exemplary embodiment, a respective length $l_t$ of transmission line 622 may satisfy a condition according to $$\left| l_t - n\frac{\lambda_g}{2} - \frac{\lambda_g}{12} \right| \leq \frac{\lambda_g}{20},$$

where n is an integer equal to or larger than 1. In an exemplary embodiment, when the microwave signal meets $(i, 1)^{th}$ metamaterial switch 618 in a closed state, the microwave signal may be reflected without shift in a phase of the microwave signal. As a result, to avoid a negative impact of a reflected wave, a length of each transmission line of plurality of transmission lines 610 may need to be a multiply of $\lambda_g/2$. Additionally, in an exemplary embodiment, a length of $$\frac{\lambda_g}{12}$$

may be added to transmission lines to take an phase shifting impact of a transmission line bend into account.

In an exemplary embodiment, first transmission line segment 624 may include a first length $l_{1t}$. In an exemplary embodiment, first length $l_{1t}$ may satisfy a condition according to $$\left| l_{1t} - (2m+1)\frac{\lambda_g}{8} \right| \leq \frac{\lambda_g}{20},$$

where m is a non-negative integer. In an exemplary embodiment, second transmission line segment 626 may include a second length $l_{2t}$. In an exemplary embodiment, second length $l_{2t}$ may satisfy a condition according to $$\left|l_{2t} - (2p+1)\frac{\lambda_g}{8}\right| \le \frac{\lambda_g}{20},$$

where p is a non-negative integer. In an exemplary embodiment, transmission line bend 628 may connect first transmission line segment 624 and a second transmission line segment 626.

Referring to FIGS. 4A and 6A, in an exemplary embodiment, $(i, k)^{th}$ metamaterial switch 608 may be configured to be closed similar to configuring metamaterial switch 400 to be closed. In an exemplary embodiment, a $(j, k)^{th}$ metamaterial switch 630 of a $j^{th}$ output line 632 of plurality of output lines 604 is configured to be opened similar to configuring metamaterial switch 400 to be opened, where $1 \le j \le N$ and $j \ne i$. In an exemplary embodiment, when metamaterial switches of all output lines except metamaterial switches of $i^{th}$ output line 606 are open and metamaterial switches of $i^{th}$ output line 606 are close, the microwave is blocked in all output lines and only passes $i^{th}$ output line 606, that is, the microwave may be routed from input line 602 to $i^{th}$ output line 606.

Figure 7A:
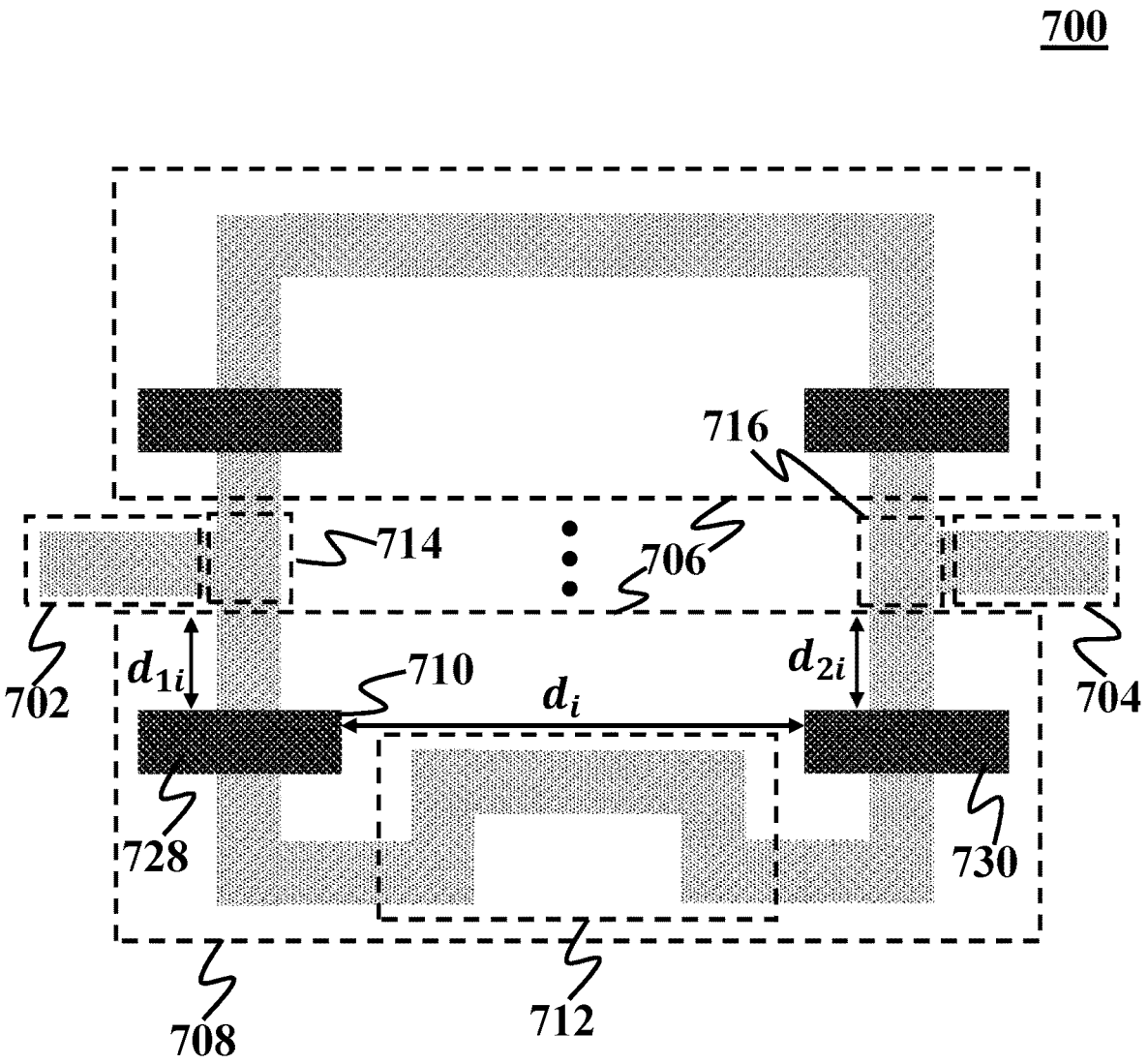
FIG. 7A shows a schematic of a top view of a metamaterial phase shifter, consistent with one or more exemplary embodiments of the present disclosure.

FIG. 7A shows a schematic of a top view of a metamaterial phase shifter, consistent with one or more exemplary embodiments of the present disclosure. In an exemplary embodiment, a metamaterial phase shifter 700 may include an input line 702, an output line 704, and a plurality of transmission lines 706. In an exemplary embodiment, an $i^{th}$ transmission line 708 of plurality of transmission lines 706 may include an $(i, k)^{th}$ metamaterial switch 710 and an $i^{th}$ delay line 712, where $1 \le i \le N$, $k \in \{1,2\}$, and N is a number of plurality of transmission lines 706. In an exemplary embodiment, $(i, k)^{th}$ metamaterial switch 710 may be configured to apply an $i^{th}$ phase shift to a microwave signal. In an exemplary embodiment, $(i, k)^{th}$ metamaterial switch 710 may apply the $i^{th}$ phase shift by routing the microwave signal from input line 702 to output line 704 responsive to $(i, k)^{th}$ metamaterial switch 710 be closed. In an exemplary embodiment, $(i, k)^{th}$ metamaterial switch 710 may be similar to one of metamaterial switch 400 and stripline metamaterial switch 400A. In an exemplary embodiment, when a length of $i^{th}$ transmission line 708 is a multiple of $\lambda_g$, $i^{th}$ transmission line 708 may apply no phase shift on a microwave signal that passes $i^{th}$ transmission line 708. However, when a length of $i^{th}$ transmission line 708 differs from a multiple of $\lambda_g$, the $i^{th}$ phase shift proportional to difference of the length of $i^{th}$ transmission line 708 and multiple of $\lambda_g$, that is, a length of $i^{th}$ delay line 712, may be applied to the microwave signal. As a result, in an exemplary embodiment, by blocking the microwave signal in all transmission lines but $i^{th}$ transmission line 708, the microwave signal may be received from output line 704 with the $i^{th}$ phase shift.

In an exemplary embodiment, metamaterial phase shifter 700 may further include a power splitter 714 and a power combiner 716. In an exemplary embodiment, power splitter 714 may connect input line 702 to a plurality of transmission lines 706. In an exemplary embodiment, power combiner 716 may connect output line 704 to a plurality of transmission lines 706. In an exemplary embodiment, a distance $d_{1i}$; between power splitter 714 and an $(i, 1)^{th}$ metamaterial switch 728 of $i^{th}$ transmission line 708 may satisfy a condition according to $$\left|d_{1i} - (2n+1)\frac{\lambda_g}{2}\right| \le \frac{\lambda_g}{20},$$

where n is a non-negative integer and $\lambda_g$ is a guided wavelength of the microwave signal. In an exemplary embodiment, a distance $d_{2i}$ between power combiner 716 and an $(i, 2)^{th}$ metamaterial switch 730 of $i^{th}$ transmission line 708 may be equal to distance $d_{1i}$.

Figure 7B:
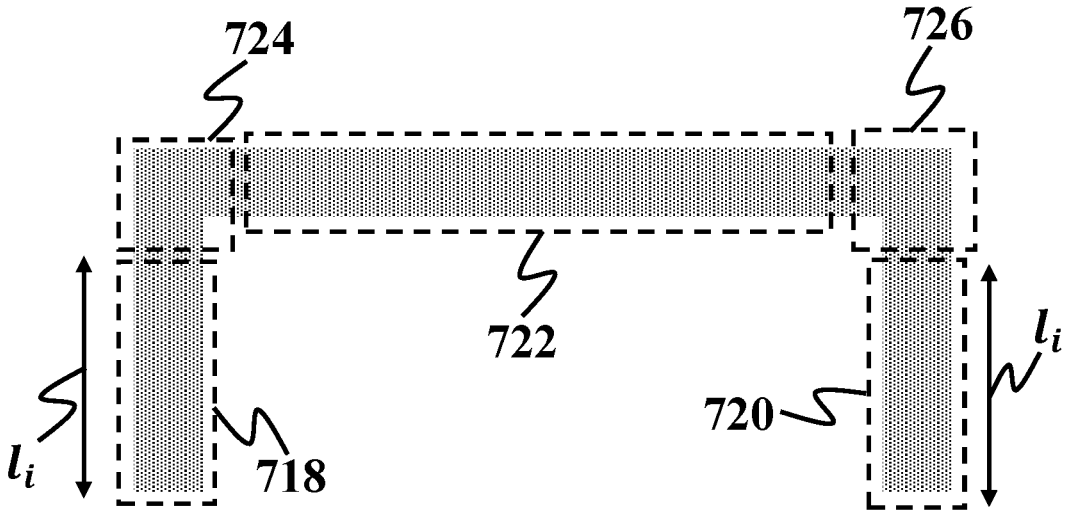
FIG. 7B shows a schematic of a delay line, consistent with one or more exemplary embodiments of the present disclosure.

FIG. 7B shows a schematic of a delay line, consistent with one or more exemplary embodiments of the present disclosure. In an exemplary embodiment, $i^{th}$ delay line 712 may include an $i^{th}$ first delay line segment 718, an $i^{th}$ second delay line segment 720, an $i^{th}$ third delay line segment 722, an $i^{th}$ first transmission line bend 724, an $i^{th}$ second transmission line bend 726. In an exemplary embodiment, a length $l_i$ of $i^{th}$ first delay line segment 718 may satisfy a condition according to $$\left|l_i - \frac{\lambda_g}{2} \times \frac{\Delta\phi_i}{360} - \frac{\lambda_g}{24}\right| \le \frac{\lambda_g}{20},$$

where $\Delta\phi_i$ is the $i^{th}$ phase shift. In an exemplary embodiment, a length of $i^{th}$ second delay line segment 720 may be equal to length $l_i$. In an exemplary embodiment, $i^{th}$ first transmission line bend 724 may connect $i^{th}$ first delay line segment 718 and $i^{th}$ third delay line segment 722. In an exemplary embodiment, $i^{th}$ second transmission line bend 726 may connect $i^{th}$ second delay line segment 720 and to $i^{th}$ third delay line segment 722. Referring to FIGS. 7A and 7B in an exemplary embodiment, a distance $d_i$ between $(i, 1)^{th}$ metamaterial switch 728 and $(i, 2)^{th}$ metamaterial switch 730 may satisfy a condition according to $$|d_i - 2l_i - m\lambda_g| \le \frac{\lambda_g}{20},$$

where m is an integer equal to or larger than 1.

Figure 7C:
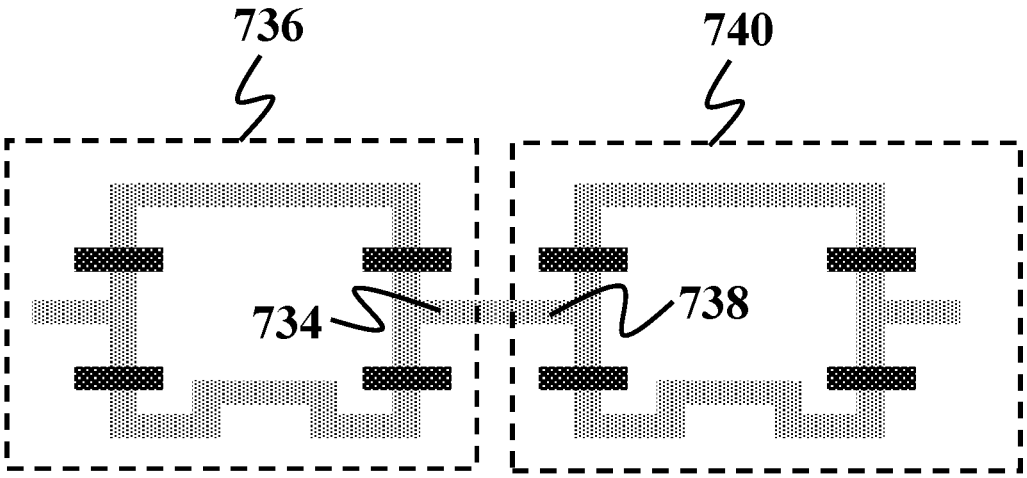
FIG. 7C shows a schematic of a top view of a serial metamaterial phase shifter, consistent with one or more exemplary embodiments of the present disclosure.

FIG. 7C shows a schematic of a top view of a serial metamaterial phase shifter, consistent with one or more exemplary embodiments of the present disclosure. In an exemplary embodiment, a serial metamaterial phase shifter 732 may be implemented by serially connecting a number of metamaterial phase shifters (each similar to metamaterial phase shifter 700). In an exemplary embodiment, serial metamaterial phase shifter 732 may be implemented by connecting an $n^{th}$ output line 734 of an $n^{th}$ metamaterial phase shifter 736 to an $(n+1)^{th}$ input line 738 of an $(n+1)^{th}$ metamaterial phase shifter 740.

Figure 7D:
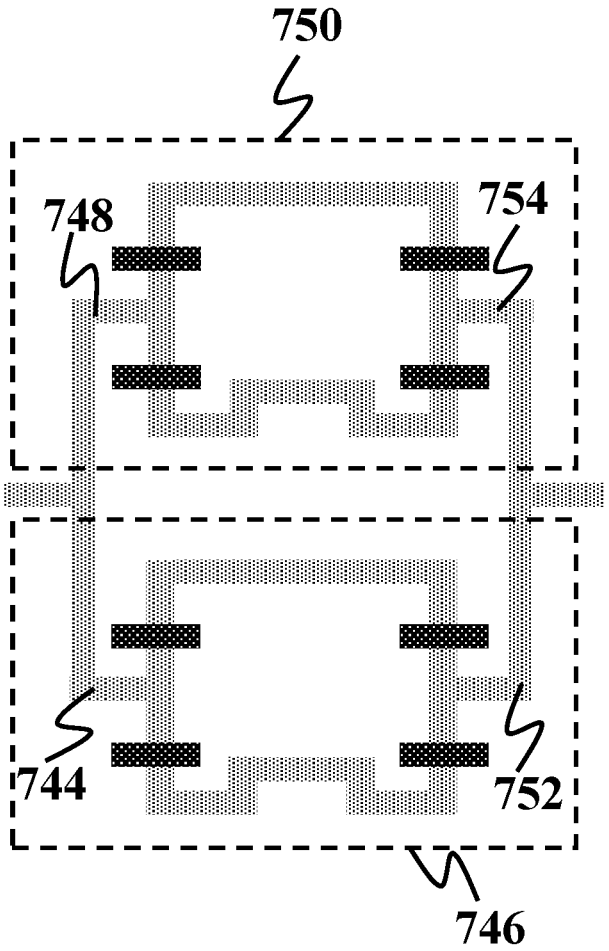
FIG. 7D shows a schematic of a top view of a parallel metamaterial phase shifter, consistent with one or more exemplary embodiments of the present disclosure.

FIG. 7D shows a schematic of a top view of a parallel metamaterial phase shifter, consistent with one or more exemplary embodiments of the present disclosure. In an exemplary embodiment, a parallel metamaterial phase shifter 742 may be implemented by in a parallel manner by connecting a plurality of metamaterial phase shifters (each similar to metamaterial phase shifter 700). In an exemplary embodiment, parallel metamaterial phase shifter 742 may be implemented by connecting an $n^{th}$ input line 744 of an $n^{th}$ metamaterial phase shifter 746 to a $(n+1)^{th}$ input line 748 of an $(n+1)^{th}$ metamaterial phase shifter 750 and connecting an $n^{th}$ output line 752 of $n^{th}$ metamaterial phase shifter 746 to an $(n+1)^{th}$ output line 754 of an $(n+1)^{th}$ metamaterial phase shifter 750.

Example 1

In this example, a performance of a method (similar to method 100) for adjusting a cutoff frequency of an EMNZ metamaterial (similar to EMNZ metamaterial 200) in terahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=0.1 μm. A height of the graphene-loaded waveguide (similar to distance a) is about a=2 μm. A width of the graphene-loaded waveguide (similar to a distance b in FIG. 2E) is about b=5 μm.

Figure 8:
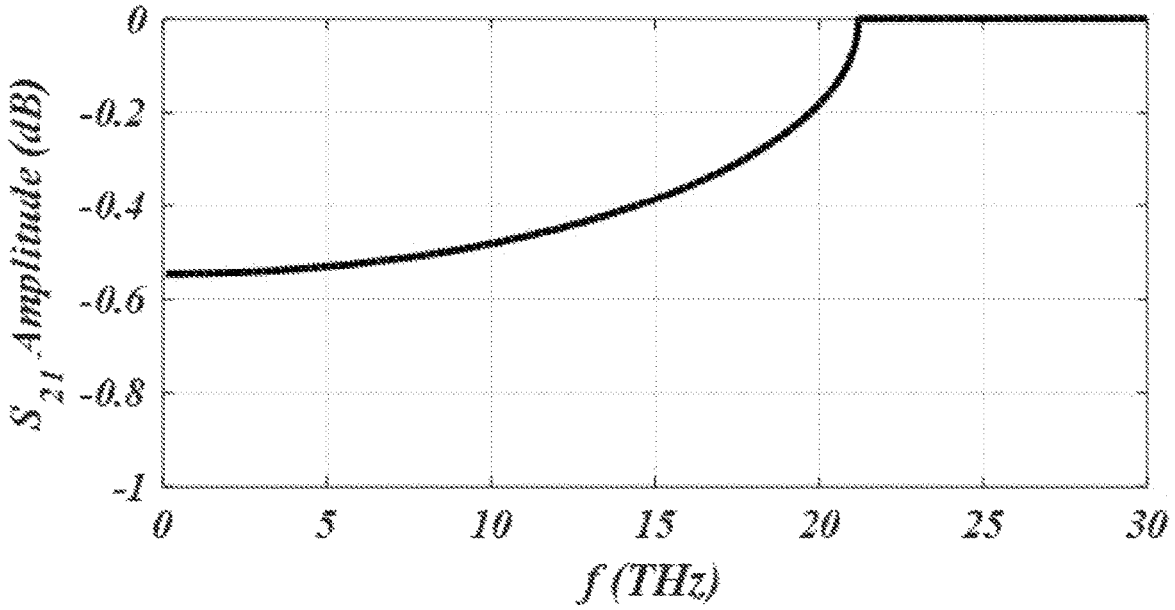
FIG. 8 shows an insertion loss of an EMNZ metamaterial in a terahertz frequency range, consistent with one or more exemplary embodiments of the present disclosure.

FIG. 8 shows an insertion loss of an EMNZ metamaterial in a terahertz (THz) frequency range, consistent with one or more exemplary embodiments of the present disclosure. Amplitude variations of an insertion loss $S_{21}$ of the EMNZ metamaterial versus frequency (f) are depicted in decibels (dB) in FIG. 8. An exemplary cutoff frequency (similar to cutoff frequency $f_c$) of the EMNZ metamaterial is about 21 THz. An insertion loss of the EMNZ metamaterial is less than about 0.6 dB in frequencies less than about 21 THz. As a result, a passing wave with a frequency less than about 21 THz may pass through the EMNZ metamaterial with a low amount of energy dissipation.

Figure 9:
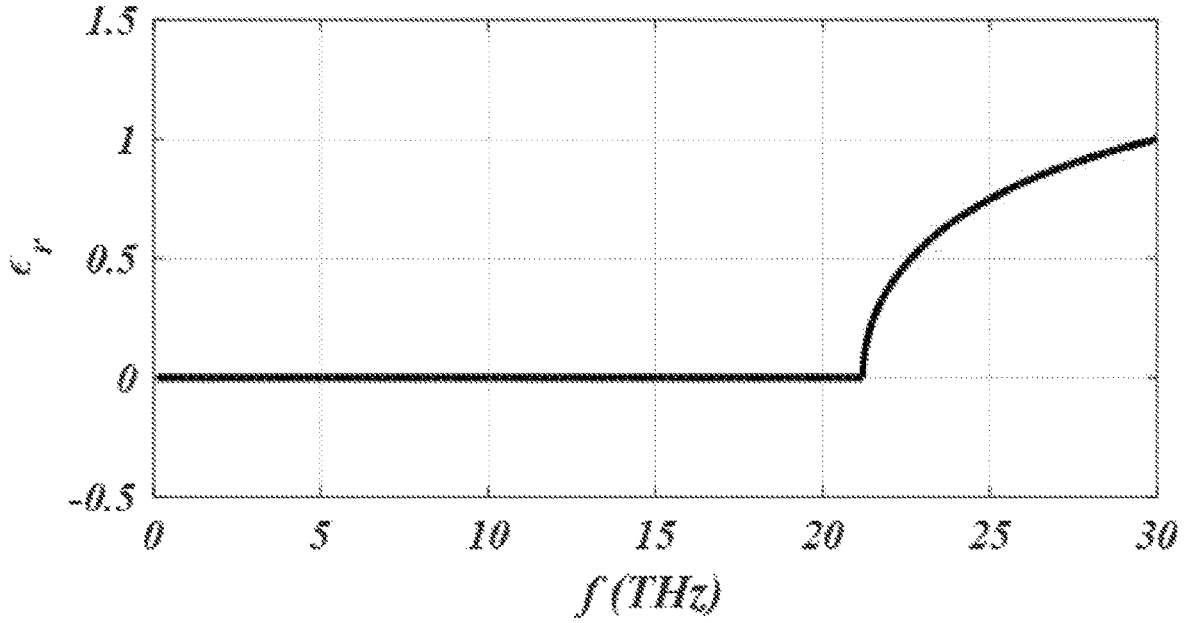
FIG. 9 shows an effective permittivity of an EMNZ metamaterial in a terahertz frequency range, consistent with one or more exemplary embodiments of the present disclosure.

FIG. 9 shows an effective permittivity $\epsilon_r$ of an EMNZ metamaterial in a terahertz (THz) frequency range, consistent with one or more exemplary embodiments of the present disclosure. An exemplary effective permittivity $\epsilon_r$ of the EMNZ metamaterial is about to zero in frequencies less than about 21 THz. In other words, a passing wave with a frequency f less than about 21 THz experiences an epsilon-near-zero (ENZ) medium when passes through the EMNZ metamaterial. In frequencies larger than about 21 THz, however, effective permittivity $\epsilon_r$ of the EMNZ metamaterial increases. As a result, the EMNZ metamaterial does not exhibit ENZ characteristics in frequencies larger than about 21 THz.

Figure 10:
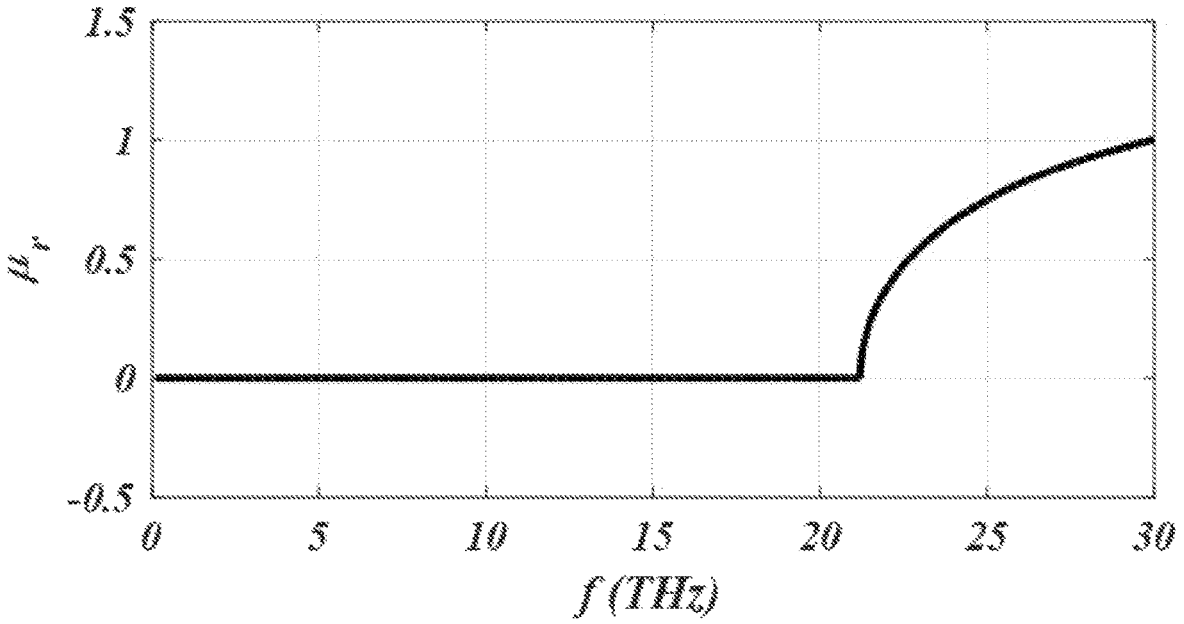
FIG. 10 shows an effective permeability of an EMNZ metamaterial in a terahertz frequency range, consistent with one or more exemplary embodiments of the present disclosure.

FIG. 10 shows an effective permeability of an EMNZ metamaterial in a terahertz (THz) frequency range, consistent with one or more exemplary embodiments of the present disclosure. An exemplary effective permeability $\mu_r$ of the EMNZ metamaterial is about to zero in frequencies less than about 21 THz. In other words, a passing wave with a frequency f less than about 21 THz experiences a mu-near-zero (MNZ) medium when the wave passes through the EMNZ metamaterial. In frequencies larger than about 21 THz, however, effective permeability $\mu_r$ of the EMNZ metamaterial increases. As a result, the EMNZ metamaterial does not exhibit MNZ characteristics in frequencies larger than about 21 THz.

Example 2

In this example, a performance of a method (similar to method 100) for adjusting a cutoff frequency of an EMNZ metamaterial (similar to EMNZ metamaterial 200) in terahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=1 nm. A height of the graphene-loaded waveguide (similar to distance a) is about a=40 nm. A chemical potential (similar to chemical potential $\mu_c$) of a graphene monolayer (similar to graphene monolayer 210) is about 0 electron-volt (eV).

Figure 11:
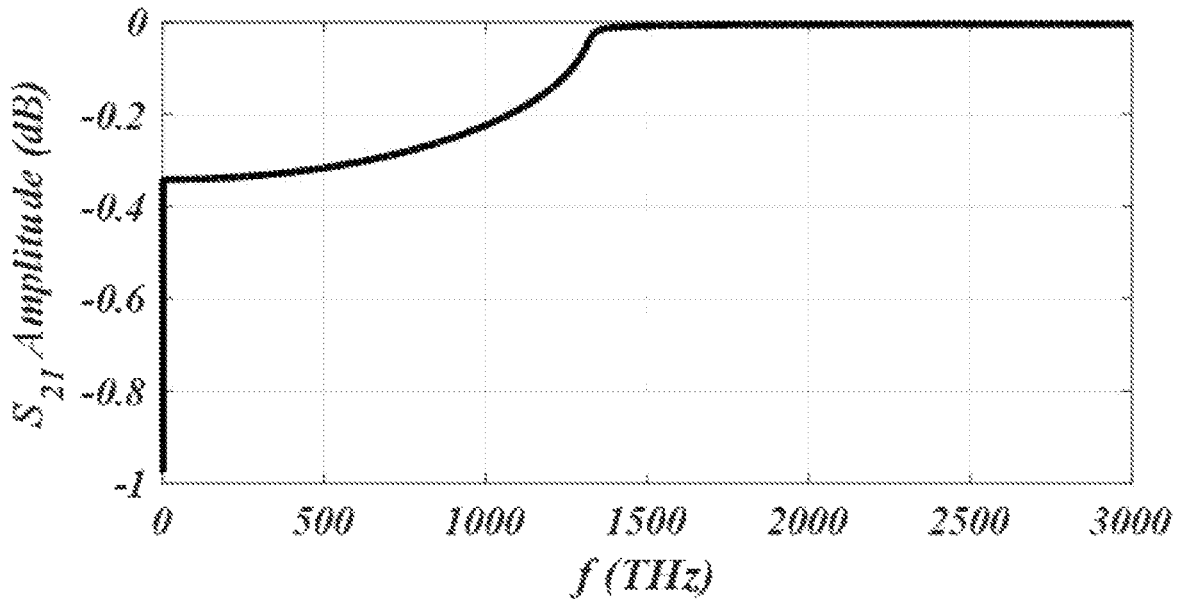
FIG. 11 shows an insertion loss of an EMNZ metamaterial in a visible light frequency range, consistent with one or more exemplary embodiments of the present disclosure.

FIG. 11 shows an insertion loss of an EMNZ metamaterial in a visible light frequency range, consistent with one or more exemplary embodiments of the present disclosure. Amplitude variations of an insertion loss $S_{21}$ of the EMNZ metamaterial in different frequencies are depicted in decibels (dB) in FIG. 11. An exemplary cutoff frequency (similar to cutoff frequency $f_c$) of the EMNZ metamaterial is about 1300 THz. An insertion loss amplitude of the EMNZ metamaterial decreases from about 1 dB to less than about 0.4 dB in a very narrow frequency range (from 0 to about 2 THz, demonstrated by an almost vertical line at the left edge of the diagram of FIG. 11), and remains less than about 0.4 dB in frequencies less than about 1300 THz. As a result, a passing wave with a frequency f in a range of about 2 THz to less than about 1300 THz may pass through the EMNZ metamaterial with a low amount of energy dissipation.

Figure 12:
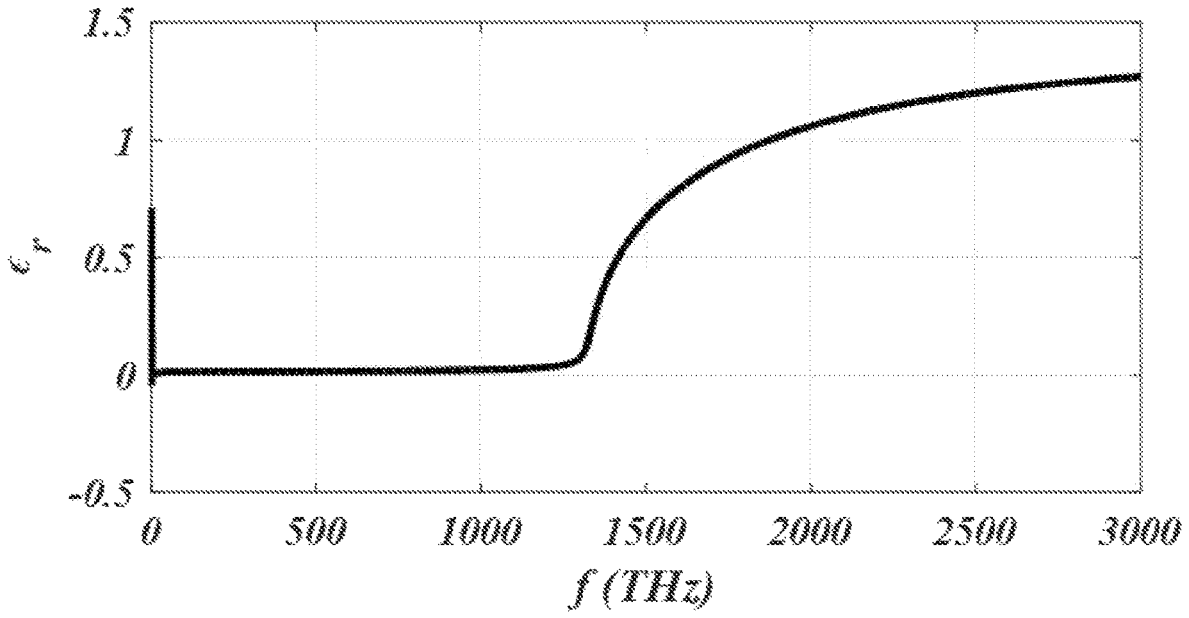
FIG. 12 shows an effective permittivity of an EMNZ metamaterial in a visible light frequency range, consistent with one or more exemplary embodiments of the present disclosure.

FIG. 12 shows an effective permittivity of an EMNZ metamaterial in a visible light frequency range, consistent with one or more exemplary embodiments of the present disclosure. An exemplary effective permittivity $\epsilon_r$ of the EMNZ metamaterial decreases from more than 0.5 to about 0 in a very narrow frequency range (from 0 to about 2 THz, demonstrated by an almost vertical line at the left edge of the diagram of FIG. 12), and remains about zero in frequencies less than about 1300 THz. In other words, a passing wave with a frequency f in a range of about 2 THz to less than about 1300 THz experiences an ENZ medium when the wave passes through the EMNZ metamaterial. In frequencies larger than about 1300 THz, however, effective permittivity $\epsilon_r$ of the EMNZ metamaterial increases. As a result, the EMNZ metamaterial does not exhibit ENZ characteristics in frequencies larger than about 1300 THz.

Figure 13:
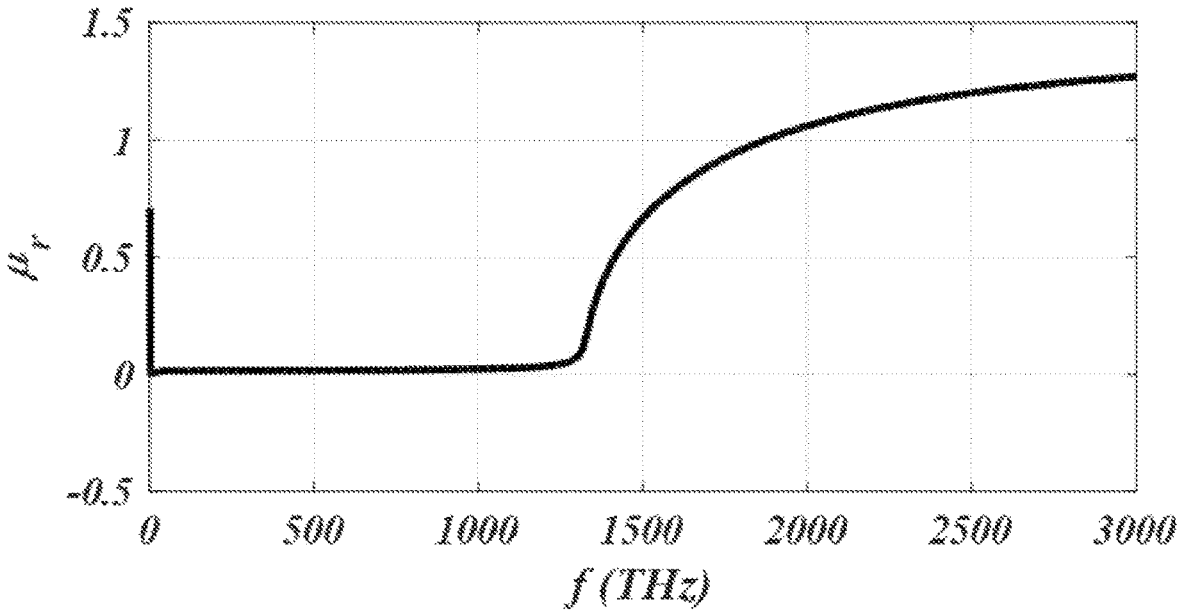
FIG. 13 shows an effective permeability of an EMNZ metamaterial in a visible light frequency range, consistent with one or more exemplary embodiments of the present disclosure.

FIG. 13 shows an effective permeability of an EMNZ metamaterial in a visible light frequency range, consistent with one or more exemplary embodiments of the present disclosure. An exemplary effective permeability $\mu_r$ of the EMNZ metamaterial decreases from more than 0.5 to about 0 in a very narrow frequency range (from 0 to about 2 THz, demonstrated by an almost vertical line at the left edge of the diagram of FIG. 13), and remains about zero in frequencies less than about 1300 THz. In other words, a passing wave with a frequency f in a range of about 2 THz to less than about 1300 THz experiences an MNZ medium when the wave passes through the EMNZ metamaterial. In frequencies larger than about 1300 THz, however, effective permeability $\mu_r$ of the EMNZ metamaterial increases. As a result, the EMNZ metamaterial does not exhibit MNZ characteristics in frequencies larger than about 1300 THz.

Example 3

In this example, a performance of a method (similar to method 100) for adjusting a cutoff frequency of an EMNZ metamaterial (similar to EMNZ metamaterial 200) in a gigahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length lof the graphene-loaded waveguide (similar to length l) is about l=0.2 mm. A height of the graphene-loaded waveguide (similar to distance a) is about a=16 mm. A chemical potential (similar to chemical potential $\mu_c$) of a graphene monolayer (similar to graphene monolayer 210) is about 0.6 eV.

Figure 14:
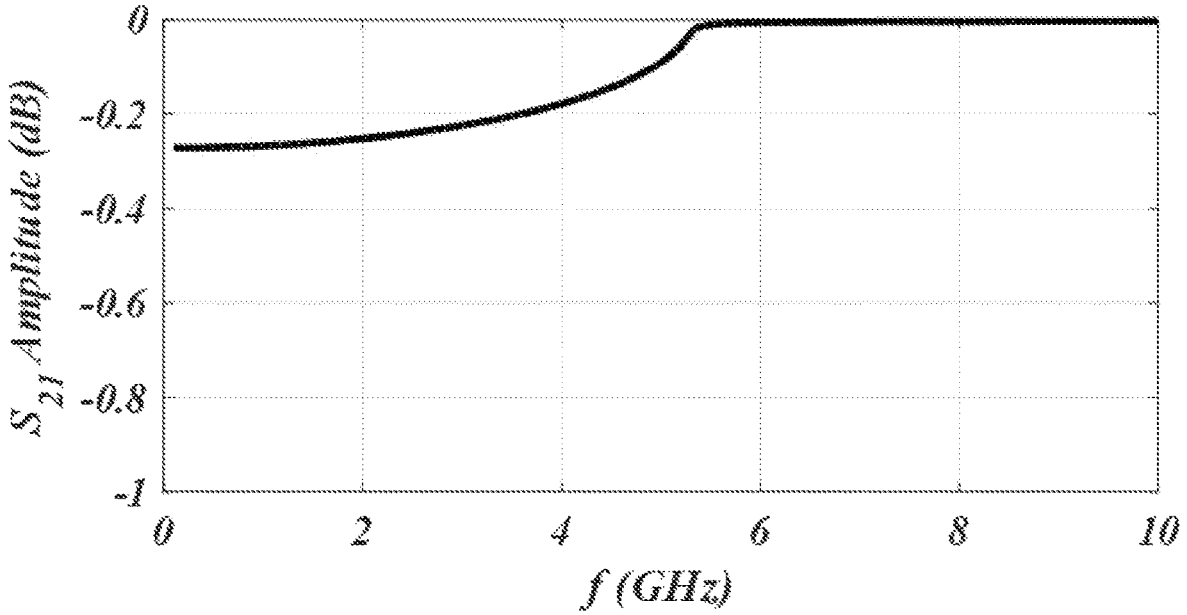
FIG. 14 shows an insertion loss of an EMNZ metamaterial in a gigahertz frequency range, consistent with one or more exemplary embodiments of the present disclosure.

FIG. 14 shows an insertion loss of an EMNZ metamaterial in a gigahertz (GHz) frequency range, consistent with one or more exemplary embodiments of the present disclosure. Amplitude variations of an insertion loss $S_{21}$ of the EMNZ metamaterial in different frequencies are depicted in decibels (dB) in FIG. 14. An exemplary cutoff frequency (similar to cutoff frequency $f_c$) of the EMNZ metamaterial is about 5 GHz. An insertion loss of the EMNZ metamaterial is less than about 0.3 dB in frequencies less than about 5 GHz. As a result, a passing wave with a frequency f less than about 5 GHz may pass through the EMNZ metamaterial with a low amount of energy dissipation.

Figure 15:
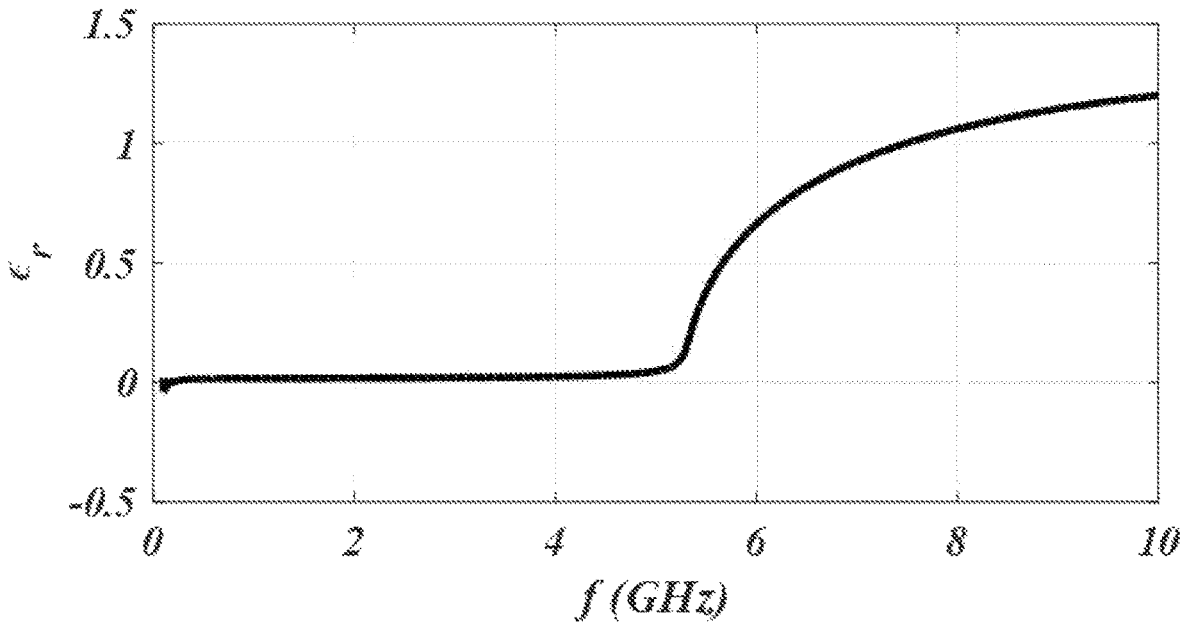
FIG. 15 shows an effective permittivity of an EMNZ metamaterial in a gigahertz frequency range, consistent with one or more exemplary embodiments of the present disclosure.

FIG. 15 shows an effective permittivity of an EMNZ metamaterial in a gigahertz (GHz) frequency range, consistent with one or more exemplary embodiments of the present disclosure. An exemplary effective permittivity $\epsilon_r$ of the EMNZ metamaterial is about to zero in frequencies less than about 5 GHz. In other words, a passing wave with a frequency f less than about 5 GHz experiences an ENZ medium when the wave passes through the EMNZ metamaterial. In frequencies larger than about 5 GHz, however, effective permittivity $\epsilon_r$ of the EMNZ metamaterial increases. As a result, the EMNZ metamaterial does not exhibit ENZ characteristics in frequencies larger than about 5 GHz.

Figure 16:
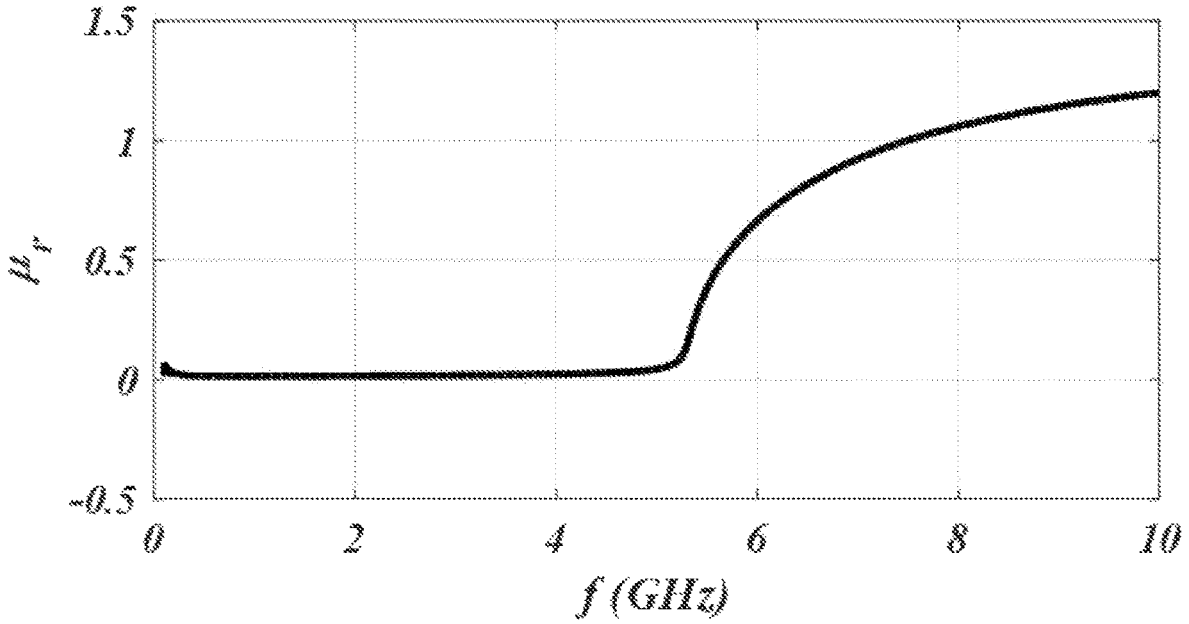
FIG. 16 shows an effective permeability of an EMNZ metamaterial in a gigahertz frequency range, consistent with one or more exemplary embodiments of the present disclosure.

FIG. 16 shows an effective permeability of an EMNZ metamaterial in a gigahertz (GHz) frequency range, consistent with one or more exemplary embodiments of the present disclosure. An exemplary effective permeability $\mu_r$ of the EMNZ metamaterial is about to zero in frequencies less than about 5 GHz. In other words, a passing wave with a frequency f less than about 5 GHz experiences an MNZ medium when the wave passes through the EMNZ metamaterial. In frequencies larger than about 5 GHz, however, effective permeability $\mu_r$ of the EMNZ metamaterial increases. As a result, the EMNZ metamaterial does not exhibit MNZ characteristics in frequencies larger than about 5 GHz.

Example 4

In this example, a performance of a method (similar to method 100) for adjusting a cutoff frequency of an EMNZ metamaterial (similar to EMNZ metamaterial 200) is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=0.1 μm. A height of the graphene-loaded waveguide (similar to distance a) is about a=4 μm. An insertion loss, an effective permittivity, and an effective permeability of the EMNZ metamaterial is obtained for different values of a chemical potential (similar to chemical potential $\mu_c$) of a graphene monolayer (similar to graphene monolayer 210). The chemical potential is set to about 0 eV and 0.6 eV.

Figure 17:
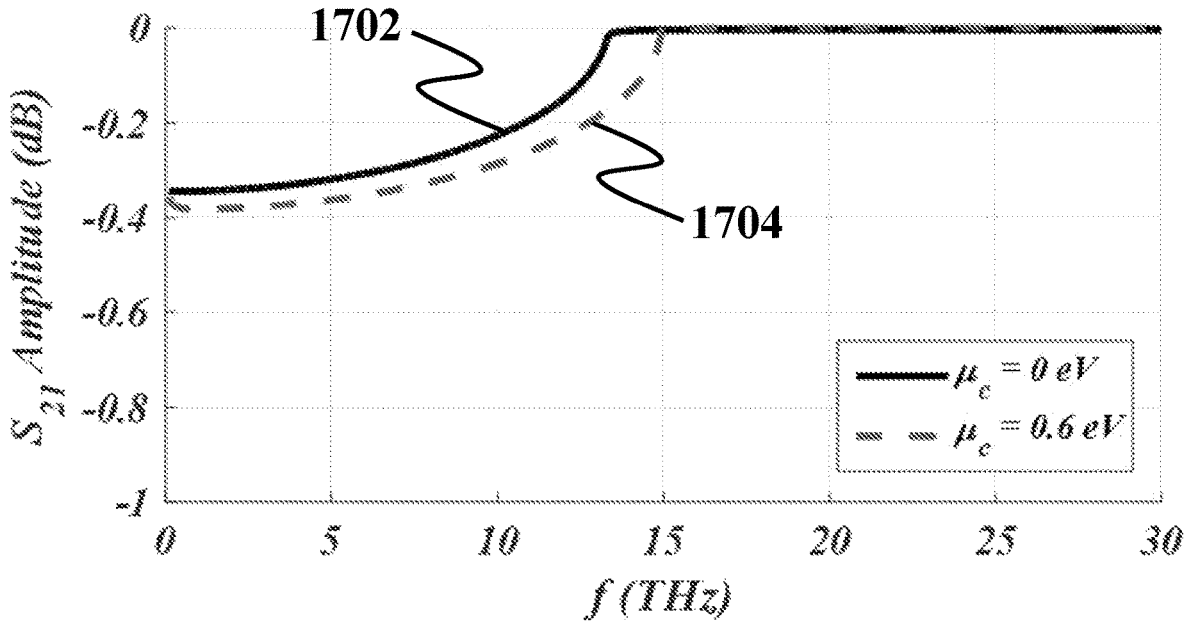
FIG. 17 shows an insertion loss of an EMNZ metamaterial for different values of a chemical potential, consistent with one or more exemplary embodiments of the present disclosure.

FIG. 17 shows an insertion loss of an EMNZ metamaterial for different values of a chemical potential, consistent with one or more exemplary embodiments of the present disclosure. Amplitude variations of an insertion loss $S_{21}$ of the EMNZ metamaterial at different frequencies are depicted in decibels (dB) in FIG. 17. An insertion loss 1702 depicts an insertion loss of the EMNZ metamaterial with chemical potential of 0 eV. An insertion loss 1704 depicts an insertion loss of the EMNZ metamaterial with chemical potential $\mu_c$, of 0.6 eV. An exemplary cutoff frequency (similar to cutoff frequency $f_c$) of the EMNZ metamaterial is about 15 THz when the chemical potential is set to about 0.6 eV. An exemplary cutoff frequency of the EMNZ metamaterial is about 13 THz when the chemical potential is set to about 0 eV. As a result, the cutoff frequency of the EMNZ metamaterial is adjusted by changing a value of the chemical potential of the graphene monolayer.

Example 5

In this example, an insertion loss and isolation performance of a metamaterial switch (similar to metamaterial switch 400) is evaluated. The metamaterial is implemented utilizing a microstrip. The metamaterial switch includes a graphene monolayer (similar to one in graphene monolayer set 418). A length of the graphene monolayer is about 25 μm, a width of the graphene monolayer is about 2 μm, a distance between a first conductive plate (similar to first conductive plate 402) and a second conductive plate (similar to second conductive plate 408) is about 6 μm, a relative permittivity of a magneto-dielectric material (similar to magneto-dielectric material 406) is about 3.75.

Figure 18:
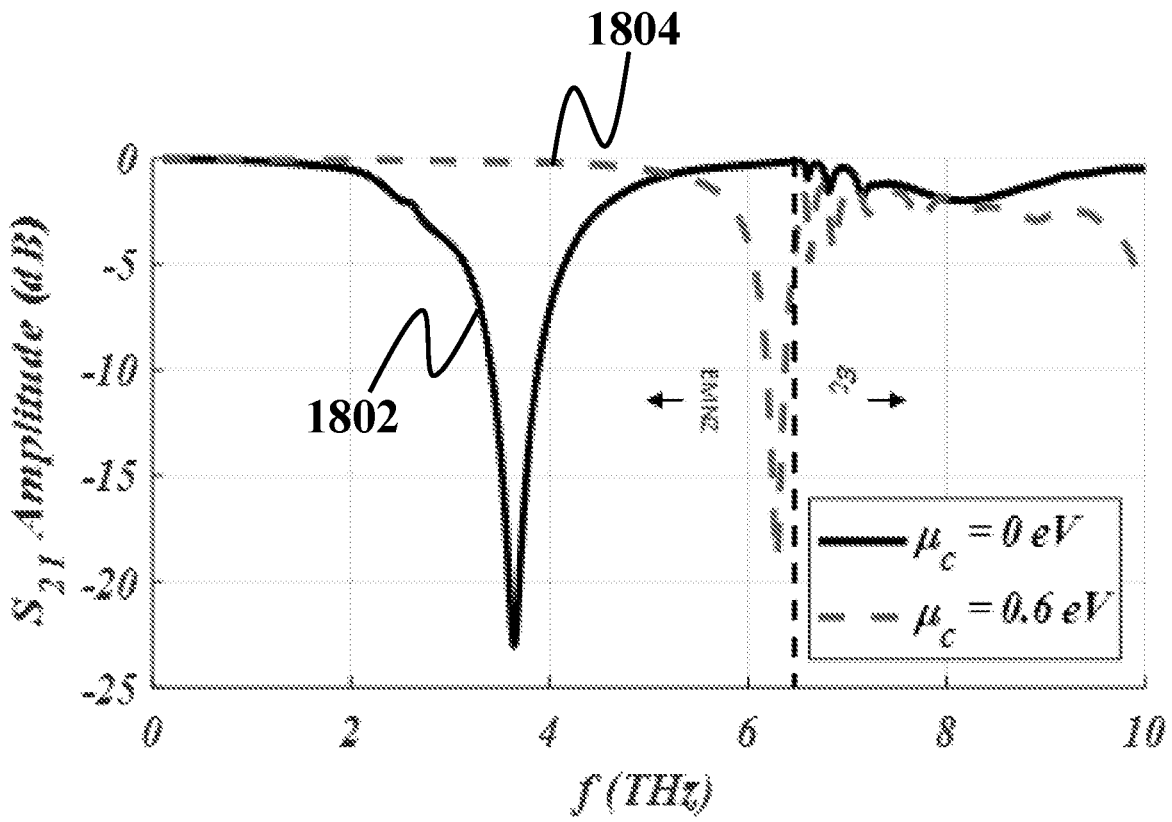
FIG. 18 shows an insertion loss of a metamaterial switch at different frequencies, consistent with one or more exemplary embodiments of the present disclosure.

FIG. 18 shows an insertion loss of a metamaterial switch at different frequencies, consistent with one or more exemplary embodiments of the present disclosure. Amplitude variations of an insertion loss $S_{21}$ of the metamaterial switch at different frequencies are depicted in decibels (dB) in FIG. 18. An insertion loss 1802 depicts an insertion loss of the metamaterial switch with chemical potential $\mu_c$ of 0 eV. An insertion loss 1804 depicts an insertion loss of the metamaterial switch with chemical potential $\mu_c$ of 0.6 eV. A maximum isolation about 23 dB is achieved at a frequency about 3.75 THz. Moreover, in a frequency range of 3.4 THz to 3.9 THz, an isolation of the metamaterial switch exceeds about 10 dB while an insertion loss is about 0.1 dB. As a result, the metamaterial switch is configured to be opened and closed for microwave signals with frequencies ranging from 3.4 THz to 3.9 THz.

Example 6

In this example, an insertion loss and isolation performance of a stripline metamaterial switch (similar to stripline metamaterial switch 400A) is evaluated. The metamaterial switch is implemented utilizing a stripline. The metamaterial switch includes a graphene monolayer set (similar to graphene monolayer set 418). A length of each graphene monolayer in the graphene monolayer set is about 25 μm, a width of the graphene monolayer is about 2 μm, a distance between a second conductive plate (similar to second conductive plate 408A) and a third conductive plate (similar to third conductive plate 414) is about 12 μm, a relative permittivity of a magneto-dielectric material (similar to magneto-dielectric material 406) is about 3.75.

Figure 19:
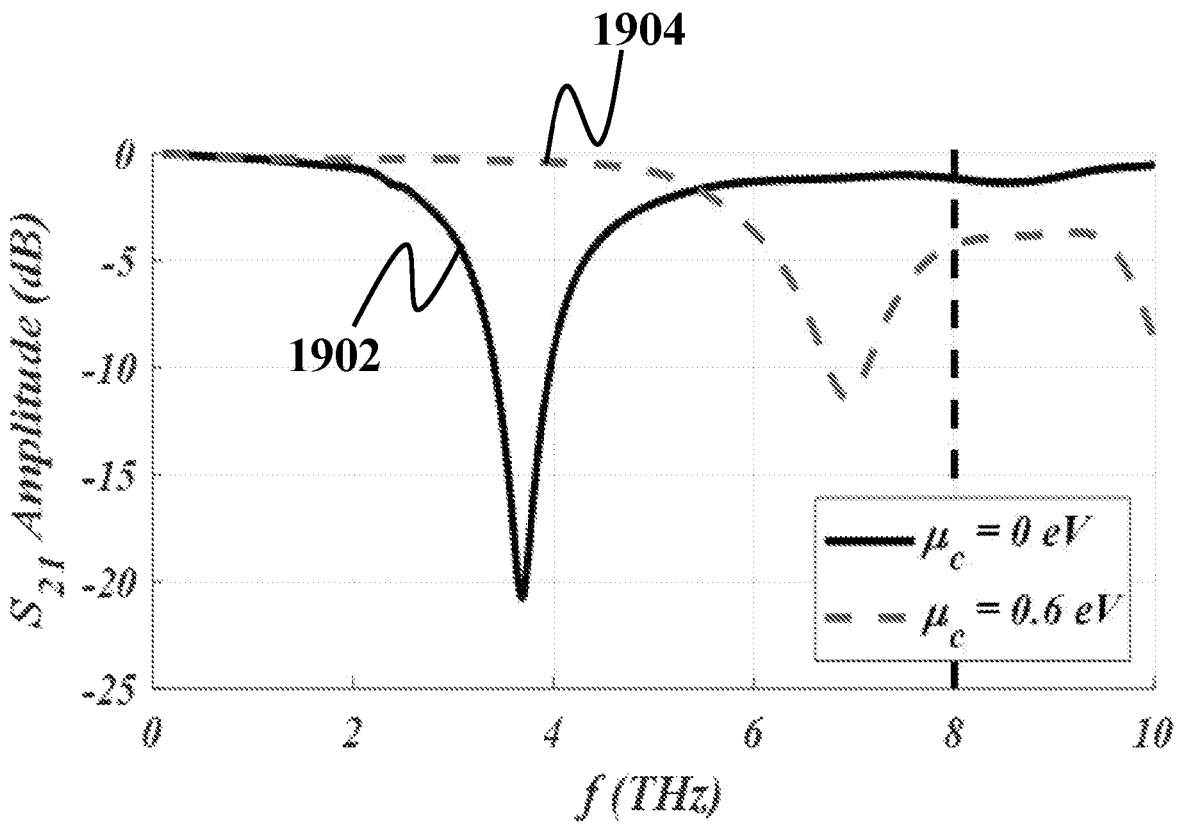
FIG. 19 shows an insertion loss of a stripline metamaterial switch at different frequencies, consistent with one or more exemplary embodiments of the present disclosure.

FIG. 19 shows an insertion loss of a stripline metamaterial switch at different frequencies, consistent with one or more exemplary embodiments of the present disclosure. Amplitude variations of an insertion loss $S_{21}$ of the stripline metamaterial switch at different frequencies are depicted in decibels (dB) in FIG. 19. An insertion loss 1902 depicts an insertion loss of the metamaterial switch with chemical potential $\mu_c$ of 0 eV. An insertion loss 1904 depicts an insertion loss of the metamaterial switch with chemical potential $\mu_c$ of 0.6 eV. A maximum isolation about 21 dB is achieved at a frequency about 3.75 THz. Moreover, in a frequency range of 3.4 THz to 4 THz, an isolation of the metamaterial switch exceeds about 10 dB while an insertion loss is about 0.1 dB. As a result, the metamaterial switch is configured to be opened and closed for microwave signals with frequencies ranging from 3.4 THz to 4 THz.

Example 7

In this example, an insertion loss and isolation performance of a wideband metamaterial switch (similar to metamaterial switch 400) is evaluated. The metamaterial switch is implemented utilizing a microstrip. The metamaterial switch includes a graphene monolayer set (similar to graphene monolayer set 418). The graphene monolayer set includes 17 graphene monolayers. A length of each graphene monolayer satisfies the fourth length condition. A length of an exemplary implementation of $i^{th}$ first delay line segment 718 in FIG. 7B ranges from about 45 μm for i=1 to 15 μm for i=9. A width of each graphene monolayer in the graphene monolayer set is about 2 μm, a distance between a first conductive plate (similar to first conductive plate 402) and a second conductive plate (similar to second conductive plate 408) is about 6 μm, a relative permittivity of a magneto-dielectric material (similar to magneto-dielectric material 406) is about 3.75.

Figure 20:
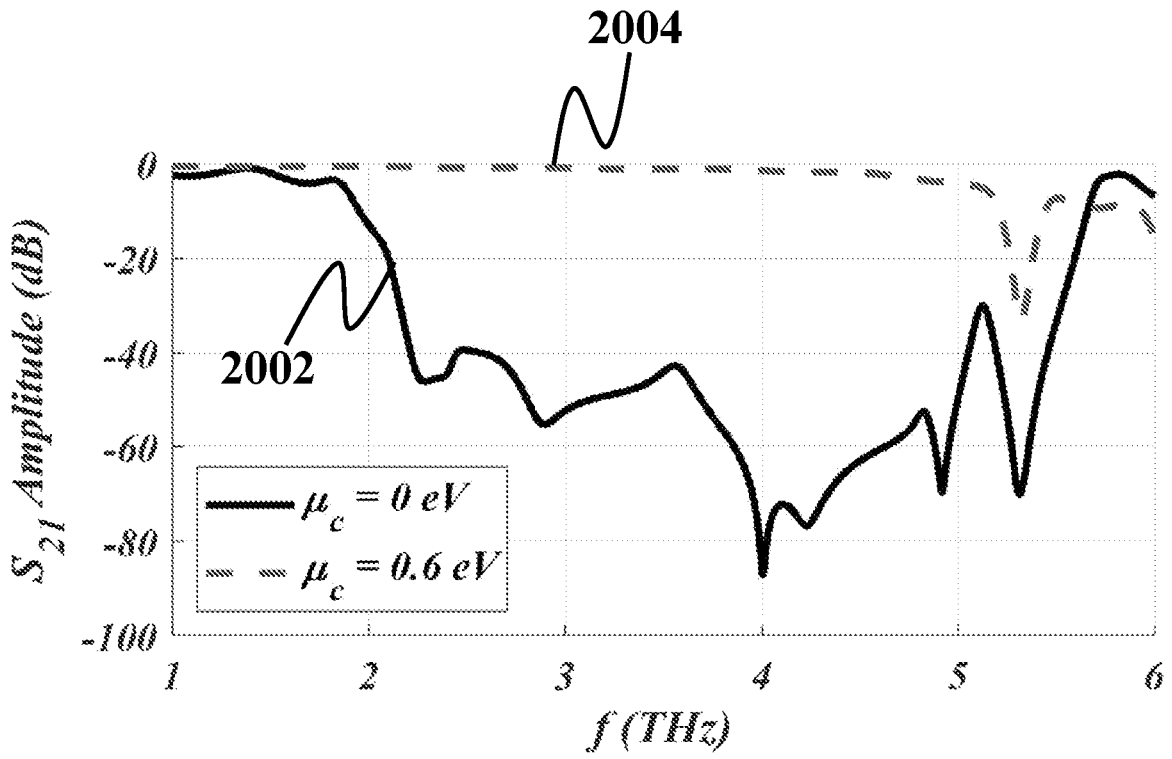
FIG. 20 shows an insertion loss of a wideband metamaterial switch at different frequencies, consistent with one or more exemplary embodiments of the present disclosure.

FIG. 20 shows an insertion loss of a wideband metamaterial switch at different frequencies, consistent with one or more exemplary embodiments of the present disclosure. Amplitude variations of an insertion loss $S_{21}$ of the wideband metamaterial switch at different frequencies are depicted in decibels (dB) in FIG. 20. An insertion loss 2002 depicts an insertion loss of the metamaterial switch with chemical potential $\mu_c$ of 0 eV. An insertion loss 2004 depicts an insertion loss of the metamaterial switch with chemical potential $\mu_c$ of 0.6 eV. An isolation of more than about 20 dB is achieved in a frequency range of 2.1 THz to 4.75 THz, while an insertion loss is about 1 dB. As a result, the metamaterial switch is configured to be opened and closed for microwave signals with frequencies ranging from 2.1 THz to 4.75 THz.

Example 8

In this example, an insertion loss and isolation performance of a metamaterial multiplexer (similar to metamaterial multiplexer 600) is evaluated. The metamaterial multiplexer include four output lines (similar to plurality of output lines 604) and is implemented utilizing a microstrip. Each output line of the plurality of output lines includes two metamaterial switches (each similar to $(i, k)^{th}$ metamaterial switch 608). The metamaterial multiplexer includes a graphene monolayer (similar to a graphene monolayer in graphene monolayer set 418). A length of the graphene monolayer is about 55 μm and a width of the graphene monolayer is about 2 μm. A distance between a first conductive plate (similar to first conductive plate 402) and a second conductive plate (similar to second conductive plate 408) is about 6 μm, a relative permittivity of a magneto-dielectric material (similar to magneto-dielectric material 406) is about 3.75. An operating frequency of the metamaterial multiplexer is about 2 THz, resulting in a guided wavelength of about 77.4 μm. A distance between an $(i, 1)^{th}$ metamaterial switch (similar to $(i, 1)^{th}$ metamaterial switch 618) and an $(i, 2)^{th}$ metamaterial switch (similar to $(i, 2)^{th}$ metamaterial switch 620) is about $$\frac{\lambda_g}{4} = 19.3\ \mu\text{m},$$

a length of a first transmission line segment (similar to first transmission line segment 624) is about and $$\frac{\lambda_g}{2} + \frac{\lambda_g}{8} + \frac{\lambda_g}{12} = 54.8\ \mu\text{m}$$

a second transmission line segment (similar to second transmission line segment 626) is about $$\frac{3\lambda_g}{4} = 29\ \mu\text{m}.$$

Figure 21:
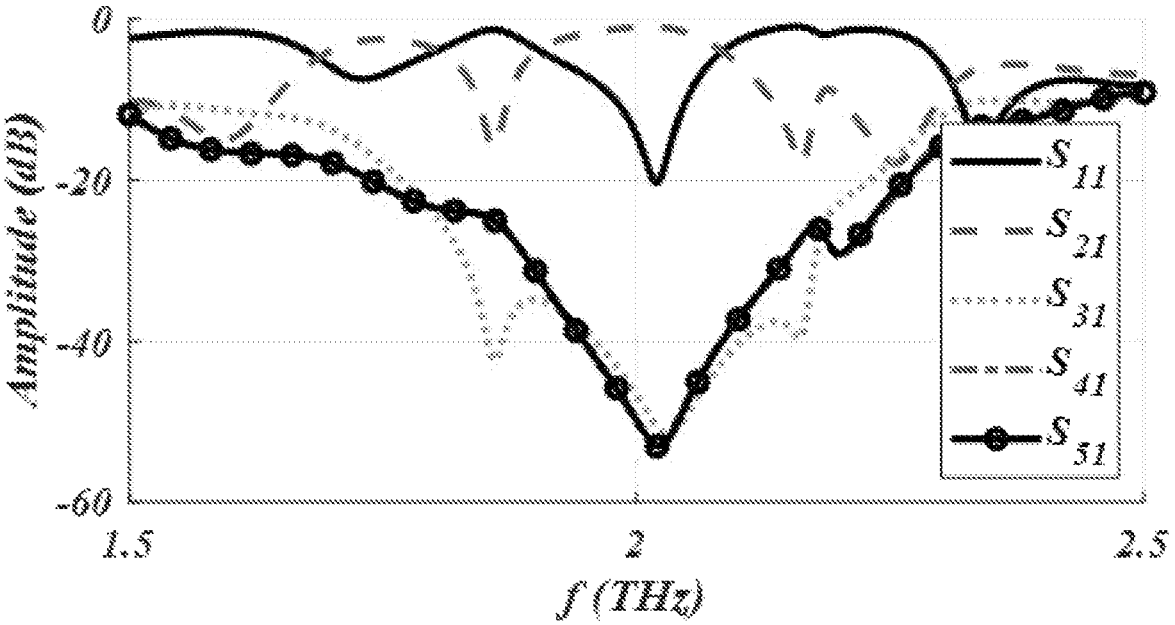
FIG. 21 shows insertion losses of a metamaterial multiplexer at different frequencies, consistent with one or more exemplary embodiments of the present disclosure.

FIG. 21 shows insertion losses of a metamaterial multiplexer at different frequencies, consistent with one or more exemplary embodiments of the present disclosure. Amplitude variations of insertion losses of the metamaterial multiplexer at different frequencies are depicted in decibels (dB) in FIG. 21. A chemical potential of metamaterial switches in exemplary implementations of $i^{th}$ output line 606 in FIG. 6A for i=2, 3, and 4 is set to about 0 eV and for i=1 is set to about 0.6 eV. In FIG. 21, $S_{11}$ is a return loss of the metamaterial multiplexer and $S_{12}$, $S_{13}$, $S_{14}$, $S_{15}$ depict insertion losses for exemplary implementations of $i^{th}$ output line 606 for i=1, 2 3, and 4, respectively. An isolation of more than about 50 dB is achieved in a frequency of about 2.1 THz, while an insertion loss is about 1 dB. Moreover, the return loss is about 20 dB at about 2.1 THz. As a result, the metamaterial multiplexer is configured to route a microwave signal with a frequency of about 2.1 THz to an exemplary implementation of $i^{th}$ output line 606 for i=2, while other output lines of an exemplary implementation of plurality of output lines 604 in FIG. 6A are effectively blocked.

Example 9

In this example, an insertion loss performance of a serial metamaterial phase shifter (similar to serial metamaterial phase shifter 732) is evaluated. The serial metamaterial phase shifter includes three serially connected metamaterial phase shifters. Each transmission line of each metamaterial phase shifter includes two transmission lines (similar to plurality of transmission lines 706). A first transmission line of an $n^{th}$ metamaterial phase shifter applies no phase shift while a second transmission line of $n^{th}$ phase shifter applies about n×60° phase shift to a microwave signal with 2 THz frequency. As a result, phase shifts of 60°, 120°, 180°, 300° may be applied to the microwave signal. A respective transmission line of each metamaterial phase shifter includes a graphene monolayer (similar to a graphene monolayer in graphene monolayer set 418). A length of the graphene monolayer is about 25 μm and a width of the graphene monolayer is about 5 μm. A distance between a first conductive plate (similar to first conductive plate 402) and a second conductive plate (similar to second conductive plate 408) is about 6 μm, a relative permittivity of a magneto-dielectric material (similar to magneto-dielectric material 406) is about 3.75.

Figure 22:
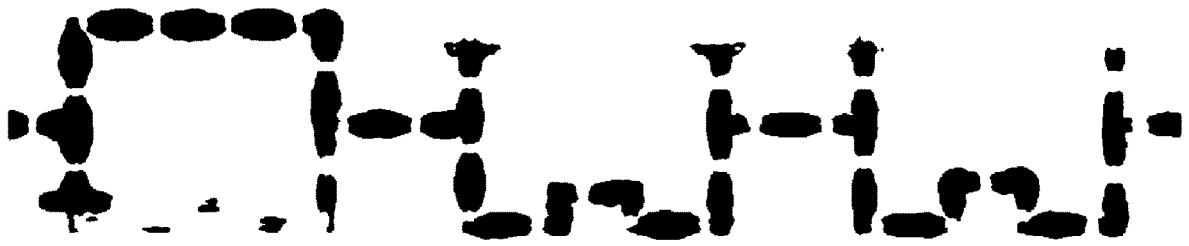
FIG. 22 shows a power of a microwave signal transmitted through a serial phase shifter, consistent with one or more exemplary embodiments of the present disclosure.

FIG. 22 shows a power of a microwave signal transmitted through a serial phase shifter, consistent with one or more exemplary embodiments of the present disclosure. A chemical potential of metamaterial switches in an exemplary implementation of $i^{th}$ transmission line 708 in FIG. 7A for i=2 of a first metamaterial phase shifter (similar to metamaterial phase shifter 700) in the serial metamaterial phase shifter is set to about 0 eV. A chemical potential of metamaterial switches in an exemplary implementation of $i^{th}$ transmission line 708 in FIG. 7A for i=1 of a second metamaterial phase shifter (similar to metamaterial phase shifter 700) in the serial metamaterial phase shifter is set to about 0 eV. A chemical potential of metamaterial switches in an exemplary implementation of $i^{th}$ transmission line 708 in FIG. 7A for i=1 of a third metamaterial phase shifter (similar to metamaterial phase shifter 700) in the serial metamaterial phase shifter is set to about 0 eV. Moreover, a chemical potential of metamaterial switches in exemplary implementation of $i^{th}$ transmission line 708 in FIG. 7A for i=1, 2, and 2 of the first metamaterial phase shifter, the second metamaterial phase shifter, and the third metamaterial phase shifter, respectively, is set to about 0.6 eV. As a result, a phase shift of about 120°+180°=300° is applied to the microwave signal.

In FIG. 22, a power of the microwave signal is shown that is passed through exemplary implementations of $i^{th}$ transmission line 708 in FIG. 7A for i=1, 2, and 2 of the first metamaterial phase shifter, the second metamaterial phase shifter, and the third metamaterial phase shifter, respectively. Meanwhile, exemplary implementation of $i^{th}$ transmission line 708 in FIG. 7A for i=2, 1, and 1 of the first metamaterial phase shifter, the second metamaterial phase shifter, and the third metamaterial phase shifter, respectively, block the microwave signal.

While the foregoing description has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A metamaterial switch, comprising:

a first conductive plate;

a first loaded conductive plate comprising:

a second conductive plate parallel with the first conductive plate; and a first tunable impedance surface set, each tunable impedance surface in the first tunable impedance surface set comprising a respective tunable conductivity, the first tunable impedance surface set positioned between the first conductive plate and the second conductive plate; and a magneto-dielectric material deposited on the first loaded conductive plate, wherein the metamaterial switch is configured to:

be closed responsive to setting a respective tunable conductivity of each tunable impedance surface in the first tunable impedance surface set larger than a conductivity threshold; and be opened responsive to setting a respective tunable conductivity of each tunable impedance surface in the first tunable impedance surface set smaller than the conductivity threshold.

2. The metamaterial switch of claim 1, wherein the metamaterial switch is further configured to:

be closed by adjusting an effective permittivity of the metamaterial switch to a positive value responsive to setting the respective tunable conductivity of the each tunable impedance surface in the first tunable impedance surface set larger than the conductivity threshold; and be opened by adjusting the effective permittivity of the metamaterial switch to zero responsive to setting the respective tunable conductivity of the each tunable impedance surface in the first tunable impedance surface set smaller than the conductivity threshold.

3. The metamaterial switch of claim 2, wherein the metamaterial switch further comprises a second loaded conductive plate comprising:

a third conductive plate parallel with the second conductive plate; and a second tunable impedance surface set, each tunable impedance surface in the second tunable impedance surface set comprising a respective tunable conductivity, the second tunable impedance surface set positioned between the first conductive plate and the third conductive plate, wherein:

the first conductive plate is positioned between the first loaded conductive plate and the second loaded conductive plate; and the metamaterial switch is further configured to:

be closed by adjusting the effective permittivity of the metamaterial switch to the positive value responsive to tuning the respective tunable conductivity of the each respective tunable impedance surface in the second tunable impedance surface set larger than the conductivity threshold; and be opened by adjusting the effective permittivity of the metamaterial switch to zero responsive to tuning the respective tunable conductivity of the each respective tunable impedance surface in the second tunable impedance surface set smaller than the conductivity threshold.

4. The metamaterial switch of claim 3, wherein a respective tunable conductivity of each tunable impedance surface in the second tunable impedance surface set is equal to a respective tunable conductivity of each respective tunable impedance surface in the first tunable impedance surface set.

5. The metamaterial switch of claim 3, wherein each tunable impedance surface in each of the first tunable impedance surface set and the second tunable impedance surface set comprises a respective graphene monolayer of a graphene monolayer set.

6. The metamaterial switch of claim 5, wherein:

a respective tunable conductivity of each tunable impedance surface in each of the first tunable impedance surface set and the second tunable impedance surface set is configured to be set larger than the conductivity threshold by applying a first electric potential to each respective graphene monolayer in the graphene monolayer set; and a respective tunable conductivity of each tunable impedance surface in each of the first tunable impedance surface set and the second tunable impedance surface set is configured to be set smaller than the conductivity threshold by applying a second electric potential to each respective graphene monolayer in the graphene monolayer set.

7. The metamaterial switch of claim 5, wherein the metamaterial switch further comprises:

a first dielectric spacer set, each dielectric spacer in the first dielectric spacer set coated on a respective graphene monolayer in the graphene monolayer set and attached to the second conductive plate, a thickness of each dielectric spacer in the first dielectric spacer set equal to or smaller than a quarter of an operating wavelength of the metamaterial switch, a permittivity of each dielectric spacer in the first dielectric spacer set equal to a permittivity of the magneto-dielectric material, and a permeability of each dielectric spacer in the first dielectric spacer set equal to a permeability of the magneto-dielectric material; and a second dielectric spacer set, each dielectric spacer in the second dielectric spacer set coated on a respective graphene monolayer in the graphene monolayer set and attached to the third conductive plate, a thickness of each dielectric spacer in the second dielectric spacer set equal to or smaller than a quarter of the operating wavelength, a permittivity of each dielectric spacer in the second dielectric spacer set equal to the permittivity of the magneto-dielectric material, and a permeability of each dielectric spacer in the second dielectric spacer set equal to a permeability of the magneto-dielectric material.

8. The metamaterial switch of claim 3, wherein a length of each impedance surface in each of the first tunable impedance surface set and the second tunable impedance surface set satisfies one of:

a first length condition according to $l_i<l_{i+1}$, where $l_i$ is a length of an $i^{th}$ tunable impedance surface in each of the first tunable impedance surface set and the second tunable impedance surface set, $1\le i\le N-1$, and N is a size of each of the first tunable impedance surface set and the second tunable impedance surface set;

a second length condition according to $l_i>l_{i+1}$;

a third length condition according to $$l_j < l_{j+1} \text{ and } l_{\left\lfloor \frac{N+1}{2}+k \right\rfloor} = l_{\left\lfloor \frac{N+1}{2}-k \right\rfloor},$$

where $$1 \le j \le \left\lceil \frac{N}{2} \right\rceil,\ 1 \le k \le \left\lfloor \frac{N}{2} \right\rfloor,$$

$\lfloor\cdot\rfloor$ is a floor operator, and $\lceil\cdot\rceil$ is a ceiling operator; and a fourth length condition according to $l_j>l_{j+1}$ and $$l_{\left\lfloor \frac{N+1}{2}+k \right\rfloor} = l_{\left\lfloor \frac{N+1}{2}-k \right\rfloor}.$$

9. The metamaterial switch of claim 3, wherein the first conductive plate is positioned between a respective proximal end and a respective distal end of each respective tunable impedance surface in each of the first tunable impedance surface set and the second tunable impedance surface set.

10. A metamaterial multiplexer, comprising:

an input line; and a plurality of output lines, an $i^{th}$ output line of the plurality of output lines comprising an $(i, k)^{th}$ metamaterial switch configured to route a microwave signal from the input line to the $i^{th}$ output line responsive to the $(i, k)^{th}$ metamaterial switch being closed, where $1 \leq i \leq N$, $k \in \{1, 2\}$, and N is a number of the plurality of output lines, an $(i, k)^{th}$ metamaterial switch comprising:

an $(i, k)^{th}$ first conductive plate;

an $(i, k)^{th}$ first loaded conductive plate comprising:

an $(i, k)^{th}$ second conductive plate parallel with the $i^{th}$ first conductive plate; and an $(i, k)^{th}$ first graphene monolayer comprising an $(i, k)^{th}$ first tunable conductivity, the $(i, k)^{th}$ first graphene monolayer positioned between the $(i, k)^{th}$ first conductive plate and the $(i, k)^{th}$ second conductive plate; and an $(i, k)^{th}$ magneto-dielectric material deposited on the $(i, k)^{th}$ first loaded conductive plate, wherein the $(i, k)^{th}$ metamaterial switch is configured to:

be closed responsive to setting the $(i, k)^{th}$ first tunable conductivity larger than a conductivity threshold; and be opened responsive to setting $(i, k)^{th}$ first tunable conductivity smaller than the conductivity threshold.

11. The metamaterial multiplexer of claim 10, wherein the $(i, k)^{th}$ metamaterial switch further comprises an $(i, k)^{th}$ second loaded conductive plate comprising:

an $(i, k)^{th}$ third conductive plate parallel with the $(i, k)^{th}$ second conductive plate;

an $(i, k)^{th}$ second graphene monolayer comprising an $(i, k)^{th}$ second tunable conductivity equal to the $(i, k)^{th}$ first tunable conductivity, the $(i, k)^{th}$ second graphene monolayer positioned between the $(i, k)^{th}$ first conductive plate and the $(i, k)^{th}$ third conductive plate;

an $(i, k)^{th}$ first dielectric spacer coated on the $(i, k)^{th}$ first graphene monolayer and attached to the $(i, k)^{th}$ second conductive plate, a thickness of the $(i, k)^{th}$ first dielectric spacer equal to or smaller than a quarter of a guided wavelength of the microwave signal, a permittivity of the $(i, k)^{th}$ first dielectric spacer equal to a permittivity of the $(i, k)^{th}$ magneto-dielectric material, and a permeability of the $(i, k)^{th}$ first dielectric spacer equal to a permeability of the $(i, k)^{th}$ magneto-dielectric material; and an $(i, k)^{th}$ second dielectric spacer coated on the $(i, k)^{th}$ second graphene monolayer and attached to the $(i, k)^{th}$ third conductive plate, a thickness of the $(i, k)^{th}$ second dielectric spacer equal to or smaller than a quarter of the guided wavelength, a permittivity of the $(i, k)^{th}$ second dielectric spacer equal to a permittivity of the $(i, k)^{th}$ magneto-dielectric material, and a permeability of the $(i, k)^{th}$ second dielectric spacer equal to a permeability of the $(i, k)^{th}$ magneto-dielectric material, wherein the $(i, k)^{th}$ first conductive plate is vertically positioned between the $(i, k)^{th}$ first loaded conductive plate and the $(i, k)^{th}$ second loaded conductive plate and is horizontally positioned between a respective proximal end and a respective distal end of each of the $(i, k)^{th}$ first graphene monolayer and the $(i, k)^{th}$ second graphene monolayer.

12. The metamaterial multiplexer of claim 11, further comprising:

a plurality of power splitters, each of the plurality of power splitters placed on a respective node of a plurality of nodes forming a graph, the plurality of power splitters comprising:

a root power splitter connected to the input line and placed on a root node of the graph; and a plurality of branching power splitters, each branching power splitter of the plurality of the power splitters connected to a respective output line of the plurality of output lines and placed on a respective branching node of the graph; and a plurality of transmission lines, each of the plurality of transmission lines placed on a respective edge of the graph.

13. The metamaterial multiplexer of claim 12, wherein:

a distance $d_i$ between an $(i, 1)^{th}$ metamaterial switch and an $(i, 2)^{th}$ metamaterial switch of the $i^{th}$ output line satisfies a condition according to $$\left|d_i - \frac{\lambda_g}{4}\right| \leq \frac{\lambda_g}{20},$$

where $\lambda_g$ is the guided wavelength;

a respective length $l_t$ of each transmission line of the plurality of transmission lines satisfies a condition according to $$\left|l_t - n\frac{\lambda_g}{2} - \frac{\lambda_g}{12}\right| \leq \frac{\lambda_g}{20},$$

where n is an integer equal to or larger than 1; and each transmission line of the plurality of transmission lines comprises:

a respective first transmission line segment comprising a respective first length $l_{1t}$ satisfying a condition according to $$\left|l_{1t} - (2m+1)\frac{\lambda_g}{8}\right| \leq \frac{\lambda_g}{20},$$

where m is a non-negative integer;

a respective second transmission line segment comprising a respective second length $l_{2t}$ satisfying a condition according to $$\left|l_{2t} - (2p+1)\frac{\lambda_g}{8}\right| \leq \frac{\lambda_g}{20},$$

where p is a non-negative integer; and a transmission line bend connecting a respective first transmission line segment and a respective second transmission line segment.

14. The metamaterial multiplexer of claim 11, wherein:

the $(i, k)^{th}$ metamaterial switch is configured to be closed by setting each of the $(i, k)^{th}$ first tunable conductivity and the $(i, k)^{th}$ second tunable conductivity larger than the conductivity threshold, each of the $(i, k)^{th}$ first tunable conductivity and the $(i, k)^{th}$ second tunable conductivity configured to be set larger than the conductivity threshold by applying a first electric potential to each of the (i, k)$^{th}$ first graphene monolayer and the (i, k)$^{th}$ second graphene monolayer; and a (j, k)$^{th}$ metamaterial switch of a j$^{th}$ output line of the plurality of output lines is configured to be opened by setting each of a (j, k)$^{th}$ first tunable conductivity of a (j, k)$^{th}$ first graphene monolayer and a (j, k)$^{th}$ second tunable conductivity of a (j, k)$^{th}$ second graphene monolayer smaller than the conductivity threshold, each of the (j, k)$^{th}$ first tunable conductivity and the (j, k)$^{th}$ second tunable conductivity configured to be set smaller than the conductivity threshold by applying a second electric potential to each of the (j, k)$^{th}$ first graphene monolayer and the (j, k)$^{th}$ second graphene monolayer, where $1 \le j \le N$ and $j \ne i$.

15. A metamaterial phase shifter, comprising:

an input line;

an output line; and a plurality of transmission lines, an i$^{th}$ transmission line of the plurality of transmission lines comprising:

an (i, k)$^{th}$ metamaterial switch configured to apply an i$^{th}$ phase shift to a microwave signal by routing the microwave signal from the input line to the output line responsive to the (i, k)$^{th}$ metamaterial switch being closed, where $1 \le i \le N$, $k \in \{1,2\}$, and N is a number of the plurality of transmission lines, the (i, k)$^{th}$ metamaterial switch comprising:

an (i, k)$^{th}$ first conductive plate;

an (i, k)$^{th}$ first loaded conductive plate comprising:

an (i, k)$^{th}$ second conductive plate parallel with the i$^{th}$ first conductive plate; and an (i, k)$^{th}$ first graphene monolayer comprising an (i, k)$^{th}$ first tunable conductivity, the (i, k)$^{th}$ first graphene monolayer positioned between the (i, k)$^{th}$ first conductive plate and the (i, k)$^{th}$ second conductive plate; and an (i, k)$^{th}$ magneto-dielectric material deposited on the (i, k)$^{th}$ first loaded conductive plate; and an i$^{th}$ delay line associated with the i$^{th}$ phase shift, wherein the (i, k)$^{th}$ metamaterial switch is configured to:

be closed responsive to setting the (i, k)$^{th}$ first tunable conductivity larger than a conductivity threshold; and be opened responsive to setting (i, k)$^{th}$ first tunable conductivity smaller than the conductivity threshold.

16. The metamaterial phase shifter of claim 15, wherein the (i, k)$^{th}$ metamaterial switch further comprises an (i, k)$^{th}$ second loaded conductive plate comprising:

an (i, k)$^{th}$ third conductive plate parallel with the (i, k)$^{th}$ second conductive plate;

an (i, k)$^{th}$ second graphene monolayer comprising an (i, k)$^{th}$ second tunable conductivity equal to the (i, k)$^{th}$ first tunable conductivity, the (i, k)$^{th}$ second graphene monolayer positioned between the (i, k)$^{th}$ first conductive plate and the (i, k)$^{th}$ third conductive plate;

an (i, k)$^{th}$ first dielectric spacer coated on the (i, k)$^{th}$ first graphene monolayer and attached to the (i, k)$^{th}$ second conductive plate, a thickness of the (i, k)$^{th}$ first dielectric spacer equal to or smaller than a quarter of a guided wavelength of the microwave signal, a permittivity of the (i, k)$^{th}$ first dielectric spacer equal to a permittivity of the (i, k)$^{th}$ magneto-dielectric material, and a permeability of the (i, k)$^{th}$ first dielectric spacer equal to a permeability of the (i, k)$^{th}$ magneto-dielectric material; and an (i, k)$^{th}$ second dielectric spacer coated on the (i, k)$^{th}$ second graphene monolayer and attached to the (i, k)$^{th}$ third conductive plate, a thickness of the (i, k)$^{th}$ second dielectric spacer equal to or smaller than a quarter of the guided wavelength, a permittivity of the (i, k)$^{th}$ second dielectric spacer equal to a permittivity of the (i, k)$^{th}$ magneto-dielectric material, and a permeability of the (i, k)$^{th}$ second dielectric spacer equal to a permeability of the (i, k)$^{th}$ magneto-dielectric material, wherein the (i, k)$^{th}$ first conductive plate is vertically positioned between the (i, k)$^{th}$ first loaded conductive plate and the (i, k)$^{th}$ second loaded conductive plate and is horizontally positioned between a respective proximal end and a respective distal end of each of the (i, k)$^{th}$ first graphene monolayer and the (i, k)$^{th}$ second graphene monolayer.

17. The metamaterial phase shifter of claim 16, further comprising:

a power splitter connected to the input line and the plurality of transmission lines; and a power combiner connected to the output line and the plurality of transmission lines.

18. The metamaterial phase shifter of claim 17, wherein:

the i$^{th}$ delay line comprises:

an i$^{th}$ first delay line segment, a length $l_i$ of the i$^{th}$ first delay line segment satisfying a condition according to $$\left| l_i - \frac{\lambda_g}{2} \times \frac{\Delta\phi_i}{360} - \frac{\lambda_g}{24} \right| \le \frac{\lambda_g}{20},$$

where $\Delta\phi_i$ is the i$^{th}$ phase shift and $\lambda_g$ is the guided wavelength;

an i$^{th}$ second delay line segment, a length of the i$^{th}$ second delay line segment equal to the length $l_i$;

an i$^{th}$ third delay line segment;

an i$^{th}$ first transmission line bend connecting the i$^{th}$ first delay line segment and the i$^{th}$ third delay line segment; and an i$^{th}$ second transmission line bend connecting the i$^{th}$ second delay line segment and the i$^{th}$ third delay line segment;

a distance $d_{1i}$ between the power splitter and an (i, 1)$^{th}$ metamaterial switch of the i$^{th}$ transmission line satisfies a condition according to $$\left| d_{1i} - (2n+1)\frac{\lambda_g}{2} \right| \le \frac{\lambda_g}{20},$$

where n is a non-negative integer;

a distance $d_{2i}$ between the power combiner and an (i, 2)$^{th}$ metamaterial switch of the i$^{th}$ transmission line is equal to the distance $d_{1i}$; and a distance $d_i$ between the (i, 1)$^{th}$ metamaterial switch and the (i, 2)$^{th}$ metamaterial switch satisfies a condition according to $$|d_i - 2l_i - m\lambda_g| \le \frac{\lambda_g}{20},$$

where m is an integer equal to or larger than 1.

19. The metamaterial phase shifter of claim 16, wherein:

the (i, k)$^{th}$ metamaterial switch is configured to be closed by setting each of the (i, k)$^{th}$ first tunable conductivity and the (i, k)$^{th}$ second tunable conductivity larger than the conductivity threshold, each of the $(i, k)^{th}$ first tunable conductivity and the $(i, k)^{th}$ second tunable conductivity is configured to be set larger than the conductivity threshold by applying a first electric potential to each of the $(i, k)^{th}$ first graphene monolayer and the $(i, k)^{th}$ second graphene monolayer; and a $(j, k)^{th}$ metamaterial switch of a $j^{th}$ output line of the plurality of output lines to is configured to be opened by setting each of a $(j, k)^{th}$ first tunable conductivity of a $(j, k)^{th}$ first graphene monolayer and a $(j, k)^{th}$ second tunable conductivity of a $(j, k)^{th}$ second graphene monolayer smaller than the conductivity threshold, each of the $(j, k)^{th}$ first tunable conductivity and the $(j, k)^{th}$ second tunable conductivity is configured to be set smaller than the conductivity threshold by applying a second electric potential to each of the $(j, k)^{th}$ first graphene monolayer and the $(j, k)^{th}$ second graphene monolayer, where $1 \leq j \leq N$ and $j \neq i$.

* * * * *